US006591842B2

(12) United States Patent
Gueret

(10) Patent No.: US 6,591,842 B2
(45) Date of Patent: Jul. 15, 2003

(54) DEVICE AND METHOD FOR APPLYING PRODUCT TO KERATINOUS FIBERS

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 189 days.

(21) Appl. No.: 09/895,076

(22) Filed: Jul. 2, 2001

(65) Prior Publication Data

US 2002/0014251 A1 Feb. 7, 2002

(30) Foreign Application Priority Data

Jun. 30, 2000 (FR) ..... 00 08504

(51) Int. Cl.[7] ..... A45D 40/26
(52) U.S. Cl. ..... 132/218; 132/317
(58) Field of Search ..... 132/218, 216, 132/120, 138, 137, 139, 160, 317, 320, 901; 401/126, 127, 129, 130, 122; 15/206, 207.2, 160, 187; D4/136

(56) References Cited

U.S. PATENT DOCUMENTS 2,460,548 A * 2/1949 Steward ..... 132/151
3,930,280 A * 1/1976 Vasas ..... 15/257.05
3,939,520 A * 2/1976 Axelsson ..... 15/167.1
3,998,235 A 12/1976 Kingsford
4,744,377 A * 5/1988 Dolan, Jr. ..... 132/218
5,137,038 A 8/1992 Kingsford
5,860,432 A 1/1999 Gueret
D445,573 S * 7/2001 Naghibi ..... D4/136

FOREIGN PATENT DOCUMENTS

FR 2 749 490 12/1997

* cited by examiner

*Primary Examiner*—Eduardo C. Robert
*Assistant Examiner*—David C. Comstock
(74) *Attorney, Agent, or Firm*—Finnegan, Henderson, Farabow, Garrett & Dunner, L.L.P.

(57) ABSTRACT

The present application relates to a device for applying a product to keratinous fibers. The device may include a plurality of applicator elements oriented substantially transversely to a longitudinal axis of the device and comprising a first applicator element and a second applicator element consecutive with the first applicator element. A first portion of a peripheral edge of the first applicator element may be at a first longitudinal distance from a corresponding first portion of the second applicator element. A second portion of the peripheral edge of the first applicator element may be at a second longitudinal distance from a corresponding second portion of the second applicator element. The second longitudinal distance may be less than the first longitudinal distance so as to define at least one narrowed section configured to engage at least one keratinous fiber between the first and second applicator elements.

298 Claims, 4 Drawing Sheets

DEVICE AND METHOD FOR APPLYING PRODUCT TO KERATINOUS FIBERS

The present invention relates to a device for applying a product to keratinous fibers. The invention is particularly suited to the applying of a product used to make up and/or treat the eyelashes. For instance, depending upon the rheology of the product, the device of the present invention may be used for treating, coloring, thickening, lengthening or curling the eyelashes.

Devices are known in the form of combs comprising a row of teeth defining grooves between them, which grooves become laden with mascara when the comb is extracted from the container with which it is associated. To allow such combs to hold sufficient reserves of mascara, thereby giving the comb sufficient autonomy, the teeth are relatively widely spaced, the spacing between two successive teeth being markedly greater than the diameter of an eyelash. Thus, the eyelashes are not gripped or engaged between the teeth of the comb, and it is, therefore, very difficult to lengthen the eyelashes, smooth them or curl them.

Other devices, particularly in the form of brushes with bristles, used in conjunction with mascaras in the form of a solid brick, might provide more overall contact of the eyelashes that are to be treated. However, because of the excessive number of bristles, it is difficult to obtain a substantial deposit of mascara on the eyelashes.

Hence, one of the optional objects of the invention is to provide a device for applying a product to keratinous fibers, particularly the eyelashes or eyebrows, which both allows sufficient product to be deposited on the fibers and allows the fibers to be caught firmly when they are engaged with the applicator device.

Other optional objects of the invention are to allow good smoothing of the fibers, good curling of the fibers, and good lengthening of the fibers.

Another optional object of the invention is to provide a device that allows swift and uniform application of the product to the fibers to be treated.

Even another optional object of the invention is to provide an applicator device which is simple to use and economical to produce.

Yet another optional object of the invention is to provide a device, which can have numerous configurations to allow numerous different make-up looks to be obtained.

A further optional object of the invention is to provide an applicator device that can be manufactured using common industrial manufacturing techniques, such as molding, pressing, or casting.

It should be understood that the invention could still be practiced without performing one or more of the optional objects and/or advantages described above. Still other optional objects will become apparent from the detailed description that follows.

As broadly described herein, the present invention optionally relates to a device for applying a product to keratinous fibers. The device may comprise a plurality of applicator elements oriented substantially transversely to a longitudinal axis of the device. The plurality of applicator elements may comprise a first applicator element and a second applicator element consecutive with the first applicator element. A first portion of one of a peripheral rim and a peripheral edge of the first applicator element may be at a first longitudinal distance from a corresponding first portion of the second applicator element. A second portion of one of the peripheral rim and the peripheral edge of the first applicator element may be at a second longitudinal distance from a corresponding second portion of the second applicator element. The second longitudinal distance may be less than the first longitudinal distance so as to define at least one narrowed section configured to engage at least one keratinous fiber between the first and second applicator elements.

Thus, according to one optional aspect of the invention, the peripheral rim or edge of an applicator element defines, in combination with a corresponding portion of a neighboring applicator element, at least one narrowed section or zone of reduced distance between the applicator elements. This narrowed section may optionally be a V-shaped one. The profile of the branches forming the narrowed section may have any of numerous shapes, particularly straight or curved.

The narrowed section or zone of decreasing width separating two consecutive applicator elements may be defined at least in part by a peripheral rim or edge portion of an applicator element. The narrowed section may be located towards the outside of the applicator device, and therefore, may make it easier for the fibers that are to be treated to access this narrowed section. In turn, the fibers may more easily be caught or engaged by the narrowed section.

Locating the narrowed section towards the outside of the applicator device differs from known configurations of combs having teeth that are arranged alternately on each side of a separation surface, and which form grooves where the respective bases of the teeth meet. In these combs, the grooves are formed in the plane of the separation surface, i.e., within the comb device.

According to one optional aspect of the invention, when the applicator device is in use and in contact with keratinous fibers, the fibers enter into the reservoir spaces between the applicator elements. These spaces may be filled with product, which is intended to be applied to the fibers. In response to movement of the applicator device with respect to the fibers, the fibers may be guided or funneled towards a narrowed section delimited by two successive applicator elements. On reaching the bottom, or nearing the bottom of the narrowed section, the eyelashes may be engaged (e.g., gripped) between the two consecutive applicator elements. Such engagement or gripping plays a part in the correct spreading of the product over the fibers, and in lengthening, curling, and separating the fibers.

Optionally, the corresponding portion of the second applicator element may also include a peripheral rim or edge portion of the second applicator element. Thus, the narrowest portion of the narrowed section or zone generally lies in the outer or envelope surface of the applicator device. The fibers to be treated using the applicator device may be guided towards these narrowed zones by the peripheral rim or edge portions of two consecutive applicator elements. These peripheral rim or edge portions may be arranged so as to converge towards each other.

Because of the converging arrangement of the peripheral rim or edge portions of the two consecutive applicator elements, it may be easier to catch and guide or funnel the fibers to be treated, particularly in order to engage the fibers between the two consecutive applicator elements, for instance, to lengthen them or curl them. The amount of product that can be taken up by the device and deposited on the fibers is increased compared with conventional combs and brushes.

Optionally, two consecutive applicator elements converge towards each other at multple points on the periphery of the device. Thus, it may be possible to provide two, three or four zones of convergence, for instance, spaced uniformly around the periphery of the applicator device. The narrowed section of a first group of two consecutive applicator elements may have the same angular position (see FIG. 12) or different angular positions (see FIGS. 11, 13, 14) compared with the narrowed section of a second group of two consecutive applicator elements.

Also optionally, the portion or portions on which the peripheral rim or edge of the first element is at a decreasing distance from a corresponding portion of the second element may be followed by a portion on which the peripheral rim or edge of the first element is at a distance that increases from a corresponding portion of the second element. The decreasing distance and/or the increasing distance may follow a progressive profile. Thus, a two-entry narrowed section may be produced, i.e., a narrowed section that a fiber may enter and be guided into from two different directions. This increases the possibilities of a fiber being engaged by such a narrowed section. Moreover, this increases the possibilities of a fiber being engaged by a narrowed section regardless of the orientation of the applicator device and, particularly, regardless of the direction of travel of the applicator device with respect to the fibers that are to be treated.

The portions of the two consecutive applicator elements with a decreasing distance therebetween may be separated from the portions of the two consecutive applicator elements with an increasing distance therebetween by portions of the two consecutive applicator elements having a constant distance therebetween. This constant distance portion may be of a finite length and may have, for instance, a non-zero finite distance between the applicator elements or a zero distance between the applicator elements, where the two elements may be in contact, or even connected, with each other.

The two-entry arrangement discussed above, may be obtained, for instance, by using applicator elements having a shape which is circular or which has corners or protrusions. For example, a converging portion followed by a diverging portion may be obtained by orienting the applicator elements with respect to each other in an appropriate way so as to obtain convergence or even tangential contact in the case of applicator elements of circular shape (see FIG. 8), or convergence or contact which is localized at the corners or protrusions (see FIGS. 2–6, 9 and 10) of non-circular applicator elements. Alternatively, a two-entry arrangement may be obtained with consecutive applicator elements having one or more rims of variable width. For instance, the two consecutive applicator elements may each have a rim with a decreasing width, that is for instance, symmetric, on each side of a portion of the rim having a greater width (see FIGS. 11–14).

The resulting narrowed sections may have an axial or longitudinal dimension associated with the fact that the applicator elements delimiting the narrowed sections may be axially or longitudinally offset or spaced from one another. The narrowed sections may also have a dimension transverse to the axis of the device owing to the shape and relative orientation of the applicator elements which delimit them.

Optionally, the applicator elements may be connected to a central support. In the present application, the phrase "central support" means that the support is situated strictly inside the envelope surface delimited by the outer peripheral rims or edges of the applicator elements. The central support may pass through the geometric center of the applicator elements or it may be offset from the geometric center.

According to certain exemplary embodiments, the application members may extend from a support and the support may be located at least adjacent to an axis of the device. Optionally, the support lacks any twisted wire material and could be formed of a plastic material from a process such as molding or embossing.

According to an optional embodiment, a peripheral rim or edge portion of a first applicator element may be in contact with at least one point of a corresponding portion of a second applicator element. Contact may be without a "bridge of material" between two consecutive applicator elements (see FIG. 5), or with a "bridge of material" physically connecting two consecutive applicator elements (see FIG. 3). If the two consecutive applicator elements are connected, the connecting bridges of material may, alone or in combination with any central support there might be, form a support for the applicator device.

According to another optional embodiment, the smallest distance separating the peripheral rim or edge portion of the first applicator element from the corresponding portion of the second applicator element may be non-zero (see FIG. 4). Moreover, this distance may optionally be equal to, or less than, the diameter of the fibers to be treated, so that the fiber can be gripped or engaged by the two consecutive applicator elements in the manner mentioned earlier.

According to an optional feature of the invention, the applicator device may include at least two narrowed sections, which all occupy the same angular position about the axis of the device.

According to another optional feature of the invention, the applicator device may include at least two narrowed sections being offset angularly from one another about the device. Thus, easier access of the fibers to the narrowed sections may result. Moreover, easier access of the fibers to the product in the reservoir spaces during relative movement of the device to the fibers may also result. The use of the product present on the applicator device may thereby be optimized.

As another option, the applicator device may comprise at least two groups of narrowed sections: a first group being arranged along a first axis and a second group being arranged along a second axis distinct from the first axis. Also optionally, the first and second axes may be parallel to the longitudinal axis of the device, with at least one of these first or second axes being distinct from the longitudinal axis of the device. The first and second axes may or may not be straight. For instance, one or the other, or both, may be helical. Also, for example, the narrowed sections may be arranged, alternatingly, along a first axis parallel with the longitudinal axis of the device and along a second axis parallel to the first (see FIGS. 2–6, 8, 11–14). Also, for example, the narrowed sections may be arranged along four axes parallel to the longitudinal axis of the device and offset by 90° around the periphery of the device (see FIGS. 9 and 10). Increasing the number of these groups of narrowed sections, which may be distributed about the periphery of the applicator device, correspondingly increases the probability that a fiber to be treated will be caught by a narrowed section.

The applicator elements may optionally have a triangular shape, circular shape, square shape or hexagonal shape. The peripheral rim or peripheral edge of one or more of the applicator elements may have a straight edge portion, a concave edge portion or a convex edge portion (see FIGS. 7*a*–7*f*).

The applicator elements of the device could have many different configurations. These elements have a configuration differing from that of bristles on conventional mascara brushes. In at least some embodiments, each application element extends at least partially around the axis of the brush to a greater extend than a bristle would extend. For example, at least some of the application elements could extend substantially continuously around the axis of the device.

An applicator device according to another optional feature of the invention may be obtained by molding a material, pressing a material, or casting a material. In particular, the material may be a thermoplastic material. Optionally, the material may be a polyethylene, a polypropylene, a polystyrene, a polyethylene terephthalate, a polycarbonate, a polyacetate, an elastomer, or a blend of such materials. The elastomer may be a polyurethane, a polyester (for instance, HYTREL®), a polyvinyl chloride, a polyethylene, a vinyl, or polyamide (for instance, PEBAX®).

Optionally, fillers, particularly slip agents, such as silicone, graphite, Teflon or molybdenum disulphide, a bactericides, magnetic particles, which may or may not be magnetized, may be incorporated into the material used to manufacture a device according to the invention.

Furthermore, the surface finish of the material may be modified, for instance, chemically or by means of $\alpha$- or $\beta$-radiation, so as to improve the ability of the applicator elements to retain the product.

Optionally, at least one of the applicator elements may be covered with flocking (see FIG. 8). The flocking may be comprised of fibers formed from nylon, cotton, acetate, viscose, polyester or a blend of such materials. Such flocking may alter the ability of the applicator device to pick up product and transport it onto the fibers, and may also alter the way in which the product will be spread out along the fibers. The flocking may comprise a mixture of fibers of different kinds and/or different lengths and/or different diameters.

The applicator device may have a substantially straight longitudinal axis or a curved longitudinal axis.

According to one optional embodiment, at least two consecutive applicator elements may be flat or substantially planar and arranged in two planes that are not mutually parallel. Such planes may be oriented obliquely with respect to the longitudinal axis of the support (see FIGS. 2–4). The angle formed by two consecutive applicator elements with respect to the axis of the applicator device may not necessarily be the same. Thus, one of the planes may be oriented obliquely with respect to the longitudinal axis of the device, while the other of the planes may be perpendicular to the axis of the device (see FIG. 5). Angles formed by the applicator elements with respect to the longitudinal axis of the applicator device may vary, for instance, from 45° to 90°, and optionally may vary from 50° to 90°, and even more optionally, may vary from 60° to 90°, wherein the angle is measured on the side of the axis where the angle is smallest. In practice, the angles may be chosen according to the characteristics desired for application of the product, and according to the desired spacing between any two consecutive applicator elements.

By way of indicative example, the greatest distance between two consecutive elements, that is to say at the point where their respective peripheral rims, peripheral edges, or corresponding portions are the furthest apart, may optionally be from 1 mm to 5 mm, preferably from 1.5 mm to 4 mm, and more preferably still, from 1.5 mm to 1.3 mm.

The number of applicator elements making up the device according to the invention may optionally be from 10 to 40, and preferably from 10 to 20. The diameter of the circle in which the cross section of the device is inscribed may optionally be from 3 mm to 10 mm, preferably from 4 mm to 8 mm, and more preferably still, from 5 mm to 7 mm.

Optionally, the applicator elements may comprise one or more members, particularly in the form of pegs, projecting from the peripheral rim or perpheral edge of the applicator element. The projecting members or pegs may extend in a mean plane or a plane in which a substantial portion of the applicator element is arranged. Alternatively, the projecting members or pegs may extend outside the plane in which a substantial portion of the applicator element is arranged (see FIG. 8). Such projecting members may make it easier for the fibers to be separated once the product has been applied.

Optionally, the contact, if any, or convergence between consecutive applicator elements, via their peripheral rims or edges, may be either tangential, in the case of applicator elements of circular shape (see FIG. 8) or localized via their respective corners or protrusions in the case of applicator elements which exhibit such corners or protrusions. The orientation of the applicator elements with respect to each other may determine the position of the narrowed section on the periphery of the device (see FIGS. 2–6).

The applicator elements may extend substantially in a plane, and have a shape exhibiting at least three corners or protrusions wherein at least one corner or protrusion extends outside the plane and at least partially delimits at least one narrowed section (see FIGS. 9 and 10). Protrusions may be formed on an applicator element having a shape with concave edge portions. Thus, as many narrowed sections as there are corners or protrusions in the shape of the applicator elements may be formed between two consecutive elements.

Optionally, the corners or protrusions of an applicator element may extend alternately towards opposite sides of the plane of the applicator element (see FIG. 10). Thus, a given applicator element may play a part in delimiting narrowed sections with each of its consecutive applicator elements. A corner extending towards a first side of the plane of the applicator element may delimit a narrowed section in conjunction with the applicator element arranged adjacent the first side of the given applicator element; a corner extending towards a second side, opposite to the first side, of the applicator element may delimit a narrowed section in conjunction with the applicator element arranged adjacent the second side of the given applicator element. With such a configuration, narrowed sections, the profile of which may be the same along the entire length of the applicator device, may be defined.

Alternatively, for a given applicator element, some of the corners or protrusions may extend towards one or the other side of the plane in which a substantial portion of the applicator element is arranged and others may be arranged more or less in the plane (see FIG. 9).

Alternatively still, the corners or protrusions for a given applicator element may all extend towards the same side of the plane.

Alternatively still, the corners or protrusions may be configured to alternately extend in the plane in which a substantial portion of the applicator element is arranged or extend towards one side of the plane (see FIG. 9). In this configuration, a first applicator element and a second applicator element, which is consecutive with the first, may be arranged face-to-face while, the second applicator element and a third applicator element, consecutive with the second, may be arranged back-to-back. This configuration may produce narrowed sections having different profiles. The profile of a narrowed section defined by two applicator elements arranged face-to-face being different from the profile of a narrowed section defined by two applicator elements arranged back-to-back.

Thus, for instance, a corner or protrusion of a first applicator element may extend towards a flat corner or protrusion of a second applicator element, thereby defining a narrowed section having a first profile. A "flat corner or protrusion" is one that substantially extends in the plane in which a substantial portion of the applicator element is arranged. Alternatively, for instance, a corner or protrusion of a first applicator element may extend towards a corner or protrusion of a second applicator element that, itself, extends toward the first element (see FIG. 10), thus defining a narrowed section having a second profile. Alternatively, a third type of profile may be obtained by having a flat first corner or protrusion of the first applicator element opposing, or in contact with, a flat second corner of the second applicator element. The flat first corner of the first applicator element may be arranged next to at least one non-flat corner also of the first applicator element, this non-flat corner extending away from the second applicator element. The flat second corner of the second element may be arranged next to at least one non-flat corner also of the second applicator element, this non-flat corner extending away from the first element (see FIG. 9). All three types of profile may be found in the same device, particularly in alternation.

According to another optional embodiment, the applicator elements may extend substantially in a plane and have a peripheral rim oriented transversely to the plane. The peripheral rim may surround all or part of the applicator element. The width of the rim, measured in the transverse orientation, may be, at least in part, of non-constant width (see FIGS. 11–14). Such a peripheral rim may delimit, in conjunction with the transverse face of the applicator element, a volume capable of holding product by capillarity. The fibers may be brought into contact with the product held in this volume when the applicator device contacts the fibers.

The width of the non-constant peripheral rim, measured along the axis of the applicator device, may range from approximately 0 at its narrower part to approximately 2 mm at its wider part. The maximum width of a peripheral rim, whether of a constant or non-constant width, may be of the order of approximately 0.2 mm to approximately 2 mm, preferably from approximately 0.4 mm to approximately 1.5 mm, and more preferably still, from approximately 0.5 mm to approximately 1 mm.

Optionally, the peripheral rim may have at least one portion of gradually increasing width, followed by a portion of gradually decreasing width (see FIGS. 11–14). Once again, a narrowed section having two entries for the fibers may be delimited in this way.

The peripheral rim may be oriented parallel to a longitudinal axis of the device (see FIGS. 11–12). Alternatively, the peripheral rim may be oriented so as to diverge with respect to a longitudinal axis of the device (see FIG. 13). Alternatively still, the peripheral rim may be oriented so as to converge with respect to a longitudinal axis of the device (see FIG. 14).

Optionally, a first peripheral rim may extend towards a first side of the plane in which a substantial portion of the applicator element is arranged, and a second peripheral rim may extend towards a second side of the plane, which is the opposite side to the first side (see FIGS. 11–14). In a specific optional embodiment, the first peripheral rim has a profile, which is offset, for instance, by 180°, with respect to the profile of the peripheral rim.

Alternatively, the peripheral rim may be formed in its entirety on one side of the plane.

Optionally, a portion of greater width of one peripheral rim of a first applicator element may be arranged facing a portion of greater width of the peripheral rim of a second applicator element, thus defining a narrowed section having a first profile (see FIGS. 11, 13 and 14). Alternatively, a portion of greater width of a first applicator element may be arranged facing a portion of smaller width of the peripheral rim of a second applicator element, thus defining a narrowed section having a second profile, different from the first profile (see FIG. 12). The two profiles may be found on the same device, for instance, in alternation.

According to another aspect, the device may comprise a plurality of applicator elements including a first substantially planar applicator element oriented at a first angle to a longitudinal axis of the device and a second substantially planar applicator element oriented at a second angle to the longitudinal axis. The second applicator element may be consecutive with the first applicator element. Further, the first angle and the second angle may differ from one another. A first longitudinal distance may be defined between a first portion of one of a peripheral rim and a peripheral edge of the first applicator element and a corresponding first portion of the second applicator element. A second longitudinal distance may also be defined between a second portion of one of the peripheral rim and the peripheral edge of the first applicator element and a corresponding second portion of the second applicator element. The second longitudinal distance may be less than the first longitudinal distance so as to define at least one narrowed section configured to engage at least one keratinous fiber between the first and second applicator elements.

According to another optional embodiment of the invention, a device for applying a product to keratinous fibers is provided which includes a plurality of substantially planar applicator elements oriented substantially transversely to a longitudinal axis of the device. The applicator elements may comprise a first applicator element having a first peripheral rim extending substantially transversely to a plane in which a substantial portion of the first applicator element is arranged, and a second applicator element consecutive with the first applicator element and having a second peripheral rim extending substantially transversely to a plane in which a substantial portion of the second applicator element is arranged. A first portion of the first peripheral rim and a first portion of the second peripheral rim may be spaced apart a first longitudinal distance. A second portion of the first peripheral rim and a second portion of the second peripheral rim may be spaced apart a second longitudinal distance. The second longitudinal distance may be less than the first longitudinal distance to define at least one narrowed section configured to engage at least one keratinous fiber between the first and second applicator elements.

According to a further optional embodiment of the present invention, a device for applying a product to keratinous fibers comprising a plurality of substantially discrete applicator elements oriented transversely to a longitudinal axis of the device is provided. The plurality of applicator elements may comprise a first applicator element oriented non-parallel to the longitudinal axis, and a second applicator element oriented nonparallel to the longitudinal axis. The second applicator element may be consecutive with the first applicator element. A first portion of one of a peripheral rim and a peripheral edge of the first applicator element may be at a first longitudinal distance from a corresponding first portion of the second applicator element. A second portion of one of the peripheral rim and the peripheral edge of the first applicator element may be at a second longitudinal distance from a corresponding second portion of the second applicator element. The second longitudinal distance may be less than the first longitudinal distance so as to define at least one narrowed section between the first and second applicator elements.

According to another optional embodiment of the invention, there is also provided an applicator comprising a stem of which a first end is secured to, or forms, an element having a grasping surface, and of which a second end, opposite the first, is secured to an applicator device according to the first optional aspect of the present invention. The stem and the applicator device may be a single piece of material formed by molding. Alternatively, the stem may be attached and secured to the applicator device by snap-fastening, bonding or welding. The material of which the stem is made may be identical to or different from the material of which the applicator device is made.

Optionally, the element having a grasping surface may be capable of reversibly closing an opening of a container equipped with the applicator. A longitudinal axis of the applicator device may be parallel or transverse to a longitudinal axis of the stem. The choice between orientations of the applicator device with respect to the stem is made according to the nature and position of the fibers to be treated, and according to the desired motion. The desired appearance of the packaging and applicator unit may also play a part.

According to another optional aspect of the present invention, a system for applying a product to keratinous fibers is provided. The system comprises an applicator according to one of the described embodiments and a container for containing the product. The container may define an opening and the container may comprise a wiper located adjacent the opening. Optionally, the wiper may be deformable. Also optionally, the product may be contained in the container and may be a cosmetic product for one of the eyelashes and the eyebrows, for instance mascara.

The wiper may be in the form of a block of foam, particularly with open cells or semi-open cells, or in the form of an annular element equipped with a lip, for instance, an elastomeric lip, which is capable of wiping the applicator device when the applicator device is extracted from the container.

According to another optional aspect, a method for applying a product is provided. The method comprises providing the system according to one of the described embodiments, loading the product onto the device, and placing the device in contact with a keratinous fiber such that at least some of the product is applied to the fiber. The product may be mascara. The keratinous fiber may be one of the eyelashes and eyebrows. The loading may include inserting the applicator into the container containing the product.

Optionally, the method may further comprise bringing the keratinous fiber into contact with the product contained between the first and second applicator elements.

Optionally still, the method may comprise guiding the keratinous fiber into the narrowed section. Even further, optionally, the method may comprise engaging the keratinous fiber in the narrowed section between the first and second applicator elements.

Also, optionally, the method may comprise removing the applicator from the container and wiping excess product from the device.

Besides the structural arrangements and procedural aspects described above, there could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention. In the drawings.

Figure 8:
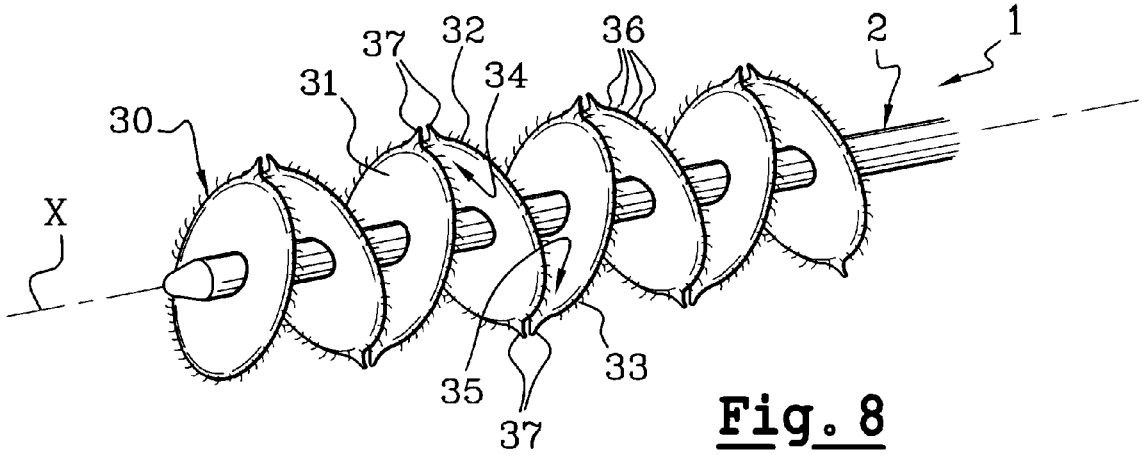
Figure 9:
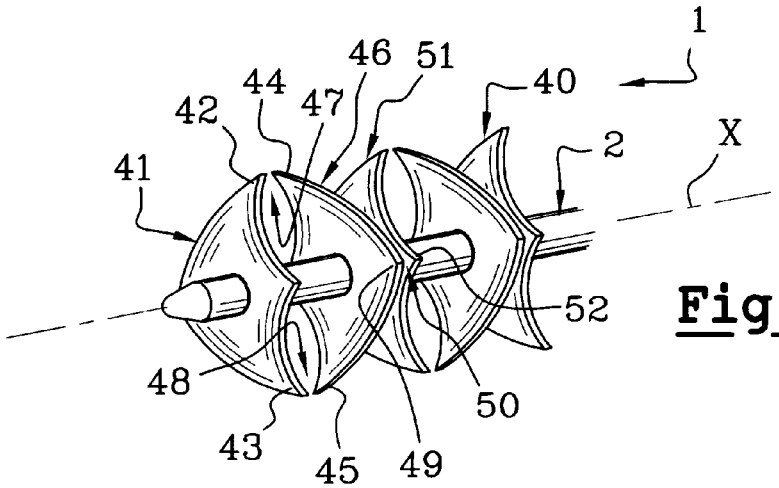
Figure 10:
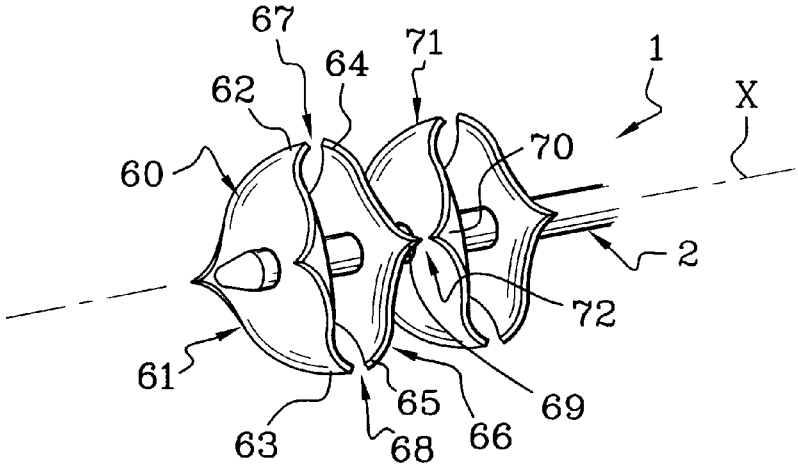
Figure 11:
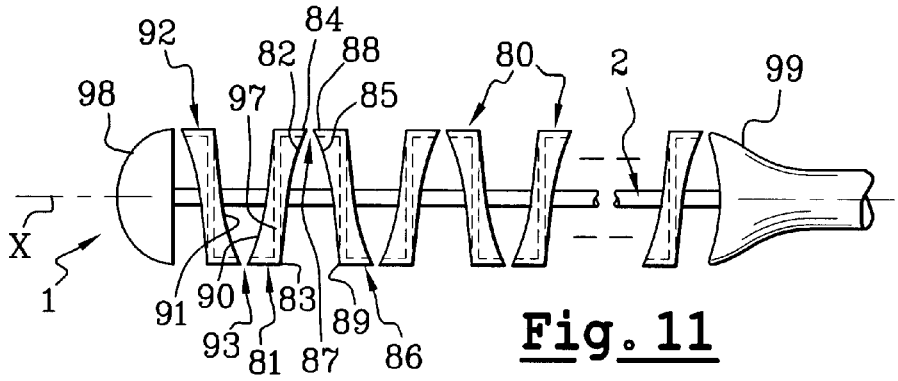
Figure 12:
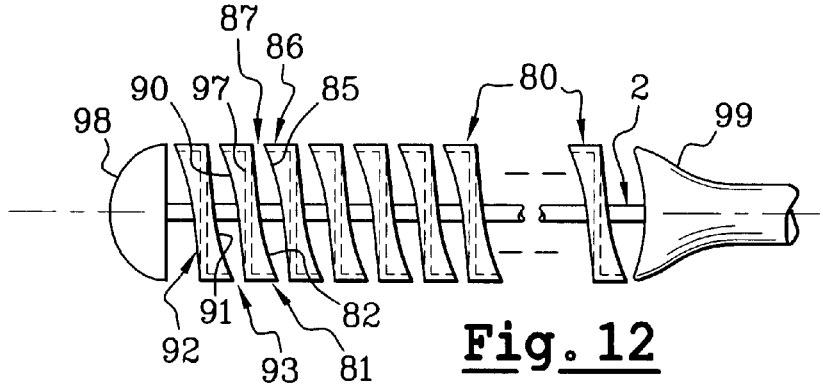
Figure 13:
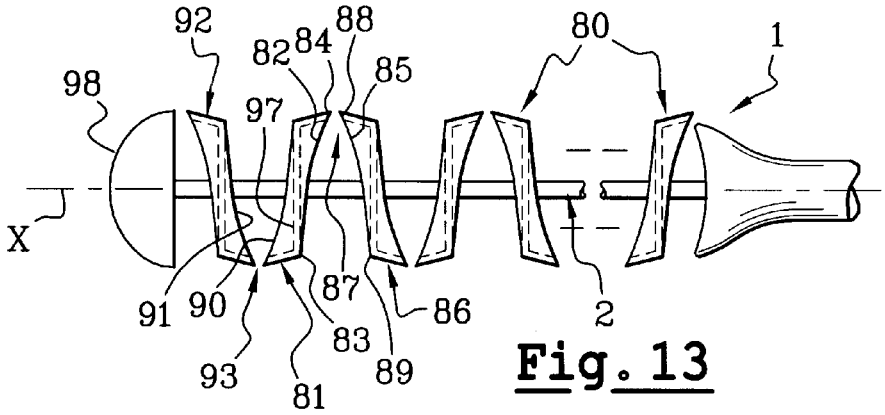
Figure 14:
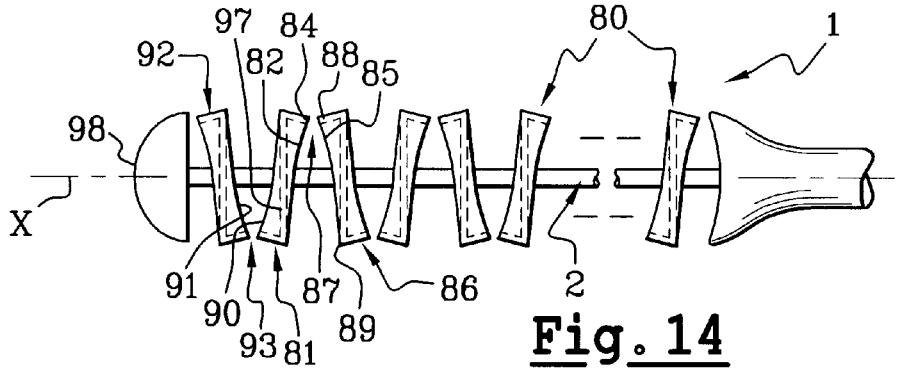

FIGS. *7a–7f* illustrate various shapes of applicator elements that can be used to produce an applicator device according to optional embodiments of the invention;

FIG. 8 relates to an applicator device according to an optional embodiment of the invention;

FIG. 9 relates to an applicator device according to an optional embodiment of the invention;

FIG. 10 relates to an applicator device according to an optional embodiment of the invention;

FIGS. 11–12 relate to an applicator device according to an optional embodiment of the invention;

FIG. 13 relates to an applicator device according to an optional embodiment of the invention; and FIG. 14 relates to an applicator device according to an optional embodiment of the invention.

In the drawings, the dimensions, particularly the spacings between the applicator elements, have been deliberately exaggerated to make the drawings easier to understand.

Reference will now be made in detail to optional embodiments of the invention, examples of which are illustrated in the accompanying drawings. Whenever possible, the same reference numbers are used in the drawings and the description to refer to the same or like parts.

Figure 1:
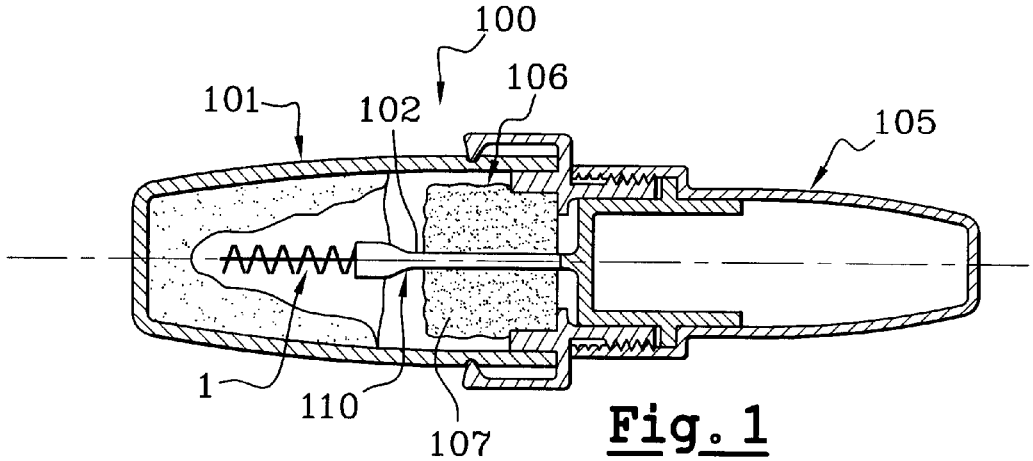
FIG. 1 depicts one optional embodiment of a system equipped with an applicator device according to the invention.

Referring to FIG. 1, a packaging and applicator unit or system 100 equipped with an applicator device 1 according to an optional embodiment of the invention is depicted. The system 100 includes a container 101 containing a reserve of cosmetic product such as mascara and an applicator 110. The applicator 110 includes an applicator device 1 fixed to one end of a wand or stem 102 aligned with the device 1. The other end of the stem 102 is secured to an element 105 for grasping, which also constitutes a cap for sealing the container 101 closed. The element 105 has a grasping surface. The container 101 includes a wringing-out member or wiper 106, here formed of a block of open-cell or semi-open-cell foam 107, through which there passes axially a slot or passage. The inner surfaces of the slot or passage are substantially contiguous when the slot or passage is not stressed, for instance, due to the passage of an applicator. When the applicator 110 is mounted on the container 101, the applicator device 1 is entirely between the block of foam 107 and the bottom of the container. Other types of wringing-out members or wipers may be used, for example a cylindrical sleeve or a wiper which terminates in a flexible annular lip.

In order to use the applicator, the user unscrews the cap formed by the element 105 for grasping and extracts the applicator 110 from the container 101. As she does this, the applicator device 1 is made to pass through the wiper 106 so that the amount of product spread over the applicator elements of the applicator device 1 can be metered. The movement of extracting the applicator is in a direction substantially longitudinal to the axis of the applicator 110 (coincident with the axis of the applicator device 1). After use, the user returns the applicator to the container, once again causing the applicator device 1 to pass through the wiper 106.

Figure 2:
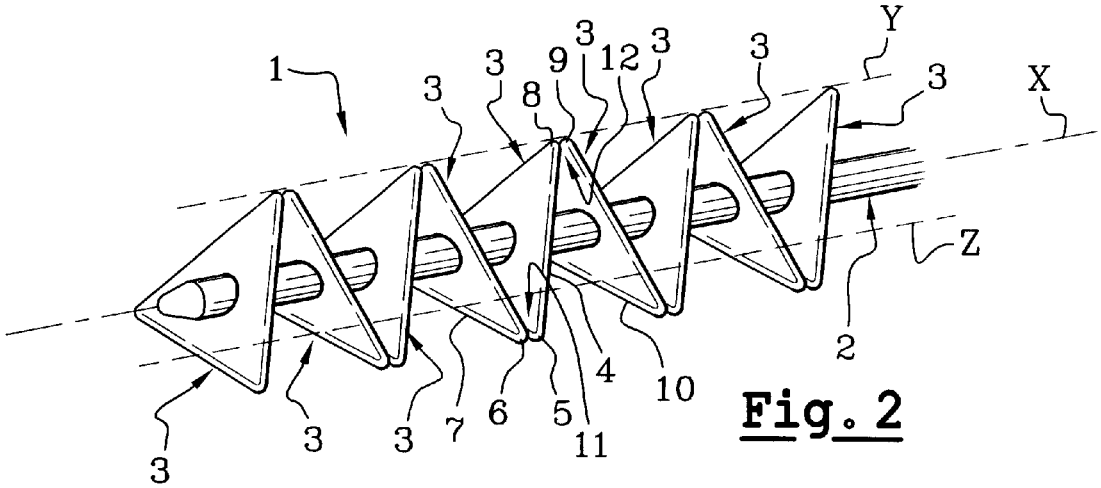
FIGS. 2–6 illustrate various alternative forms of an applicator device according to optional embodiments of the invention.

FIG. 2 depicts a partial view of an applicator device 1 according to a first optional embodiment. The applicator device, with longitudinal axis X, comprises a central support 2 on which a number of applicator elements 3 are connected. The applicator device according to this optional embodiment is obtained by molding a polyethylene. The applicator elements 3 are substantially planar and of triangular shape.

The applicator elements 3 are oriented obliquely with respect to one another and with respect to the longitudinal axis. A given applicator element 4 has its base 5 in contact (or substantially in contact) with the base 6 of an applicator element 7 located to one side of the given applicator element 4. The vertex 8 of the given applicator element 4 is in contact (or substantially in contact) with a corresponding vertex 9 of an applicator element 10 situated on the other side of the given applicator element 4.

Thus, a first narrowed section 11 is formed between the applicator element 4 and the applicator element 7. This first narrowed section 11 has a narrowest zone, which extends across the entire width of the common base of the elements 4 and 7. Likewise, another narrowed section 12 is formed between the applicator element 4 and the applicator element 10. The narrowest zone of this second narrowed section 12 is located where the vertices 8 and 9 meet.

Because the applicator elements 4 and 10 are oriented obliquely, the narrowed section 12 formed at the vertices 8 and 9 separates a first zone or portion, which is delimited by two edge portions gradually converging towards each other, from a second zone or portion, which is delimited by two edge portions gradually diverging from one another. Each zone is an entry for funneling or guiding fibers to be treated towards the narrowed section. Thus, in this instance, two entries are provided for guiding the fibers towards the same narrowed section 12. The same is true of the narrowed section 11. The zone or portion with gradually converging edges is separated from the zone or portion with gradually diverging edges by a portion with parallel edges corresponding to the width of the bases 5, 6 of the applicator elements 4 and 7.

During use, the eyelashes falling between two consecutive applicator elements will be brought into contact with the product held by capillarity on the transverse surfaces of the applicator elements 3. In response to the movement of the applicator device relative to the eyelashes, the latter will be guided towards a narrowed section 11, 12 formed at the meeting points of the vertices and, respectively, of the bases, of two consecutive applicator elements. The eyelashes will then be engaged or gripped in the narrowed section by the two consecutive applicator elements forming the narrowed section. This gripping encourages smoothing of the eyelashes, and lengthening and curling thereof.

Figure 3:
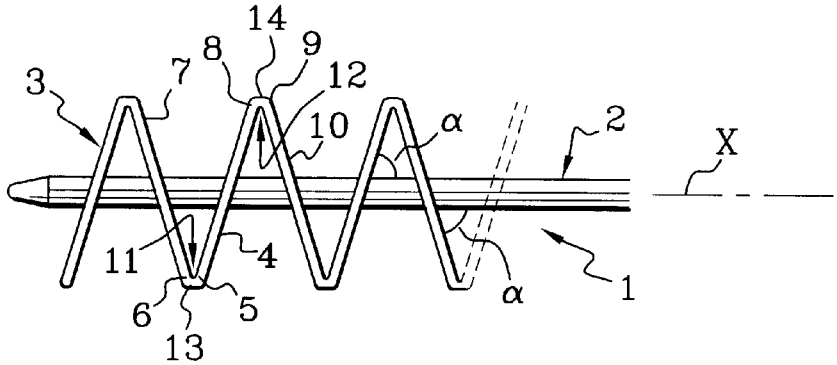

As shown in FIG. 3, at the narrowed section 11, 12, the vertices 8, 9 and the parallel bases of two consecutive elements (4, 7; 4, 10) may be connected by bridges of material 13, 14. These bridges of material 13, 14 allow the applicator device to be given greater rigidity, and allow the eyelashes to be caught or engaged even more firmly by the narrowed section thus defined. The angle of inclination a of the applicator elements 3 with respect to the axis X of the device is approximately 80°.

Figure 4:
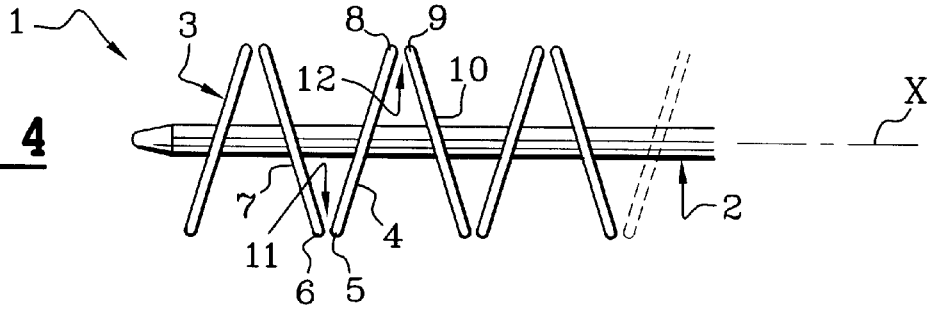

According to another optional embodiment illustrated in FIG. 4, at the narrowed section 11, 12, the vertices 8, 9 and the parallel bases 5, 6 of two consecutive elements (4, 7; 4, 10) are distant from one another. According to at least some embodiments, this distance is small enough to allow the narrowed section 11 and 12 to catch and engage the eyelashes with a view to smoothing them, lengthening them or curling them. These optional embodiments allow a greater amount of product to be deposited on the fibers to be treated, and offers a more gentle use.

Although not depicted in FIGS. 2–4 (for reasons of clarity of the drawing), the central support 2 may comprise front and rear parts axially delimiting the application zone or effective working zone of the applicator device. These front and rear parts may be profiled so as to facilitate the applicator device 1 passing through the wiper discussed above with reference to FIG. 1. Such front and rear parts, for instance, are illustrated with reference to the optional embodiments of FIGS. 11–14, which will be subsequently described. Furthermore, the end of the support 2 that is opposite the free end of the applicator device 1 may comprise means (not shown in the partial views of FIGS. 2–4) for allowing the applicator device to be mounted, for instance, by snap-fastening, inside a hollow end of a connecting wand or stem.

Figure 5:
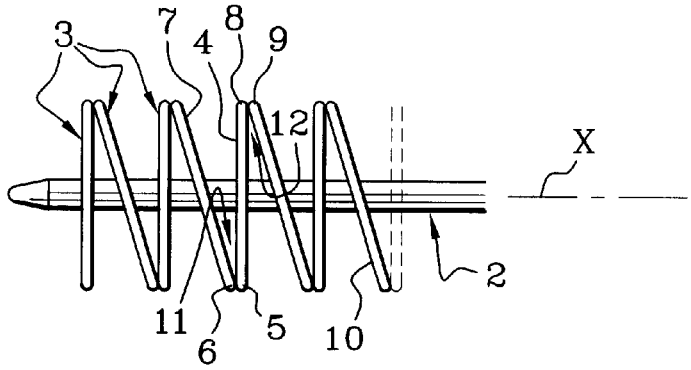

In FIGS. 2–4, the applicator elements (generally bearing the numerical reference 3) are inclined, two by two, symmetrically with respect to one another. In FIG. 5; for each pair of consecutive applicator elements 3, one of the pair of applicator elements 4 is oriented perpendicular to the axis of the device, and the other of the pair of applicator elements 10 is arranged obliquely with respect to the axis of the device 1. Such an arrangement makes it possible for the narrowed sections 11, 12 to be spaced more closely together along the longitudinal axis of the device without excessively reducing the amount of product that can be picked up by the applicator device 1 and without excessively reducing the ability of the fibers to be engaged between the applicator elements 3 of the device 1. Furthermore, at the narrowed sections 11,12, the corresponding vertices 5, 6 and 8, 9 are in contact with one another without, however, being connected by bridges of material. This configuration makes it possible to obtain an engagement of the fibers between the applicator elements at the narrowed section that may be firmer or more robust than that which may be obtained with the optional embodiment of FIG. 4, but that may be a less firm or less robust engagement that that which may be obtained with the optional embodiment of FIG. 3.

In the optional embodiments of FIGS. 2–5, a first group of narrowed sections 12 is arranged along a first axis Y parallel to the longitudinal axis X. A second group of narrowed sections 11 is arranged along a second axis Z parallel to the axis X of the applicator device 1. The axes Y and Z are located on opposite sides from one another with respect to the axis X of the device.

Alternatively, by appropriately orienting the triangular applicator elements, it is possible to obtain a configuration in which each applicator element is in contact, essentially at a single vertex, with each of the two applicator elements that are consecutive to it. With such a configuration, the narrowed sections are distributed in three groups arranged along three axes separated angularly, for instance, by 60°.

Figure 6:
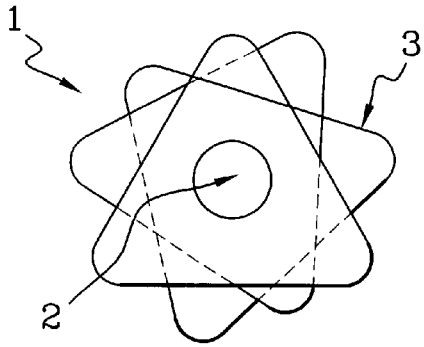

In the optional embodiment of FIG. 6, the narrowed sections are offset angularly by a few degrees from one another, so that they are distributed, uniformly or otherwise, around the periphery of the applicator device 1. This arrangement allows the presence of a greater number of applicator elements 3 on the device 1. More applicator elements on the device would result in more lengthening and separating of the eyelashes, but at the expense of the amount of product deposited, which will be a bit lower. Such a configuration will therefore be more suitable for instances where a natural and not too heavy make-up look is desired.

Figure 7A:
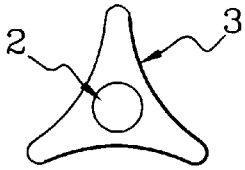
Figure 7D:
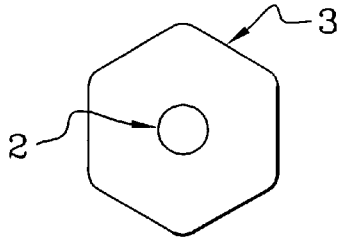
Figure 7B:
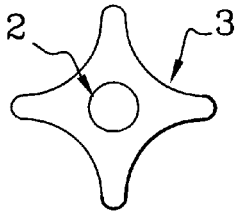
Figure 7E:
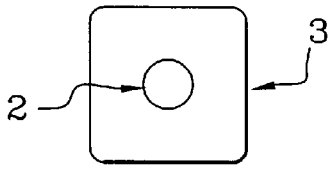
Figure 7C:
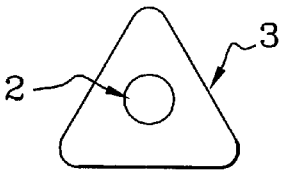
Figure 7F:
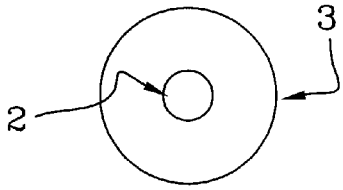

As is apparent from FIGS. 7*a*–7*f*, the applicator elements 3 may have any shape. In FIG. 7*a*, the applicator element 3 is in the shape of a triangle with concave edges. This shape has a relatively pronounced protrusion effect at the corners of the applicator element 3. In FIG. 7*b*, the applicator element 3 is in the shape of a square with concave edges. This shape has substantially the same protrusion or projection effect at the corners of the applicator element 3 as the applicator element of FIG. 7*a*. In FIG. 7*c*, the applicator element 3 is in the shape of a triangle with straight edges. In FIG. 7*d*, the applicator element 3 is in the shape of a hexagon with straight edges. In FIG. 7*e*, the applicator element 3 is in the shape of a square with straight edges. In FIG. 7*f*, the applicator element 3 is in the shape of a circle.

In the optional embodiment of FIG. 8, the applicator elements (generally bearing the numerical reference 30) includes substantially planar and substantially discrete discs. Specifically, two discs 31 and 32 are inclined with respect to one another by about 750, so as to converge at a point on their periphery, thereby defining a narrowed section 34. By contrast, the disc 32 converges towards the disc 33, arranged on the opposite side to the disc 31, at a point diametrically opposite the point at which the disc 32 converges towards the disc 31. Thus a narrowed section 35 is formed diametrically opposite the narrowed section 34. The applicator elements 30 are covered with a covering of flocking 36. Each of the discs 31 to 33 at its periphery and near a narrowed section 34, 35, has a peg or projection 37 projecting from the peripheral edge of the corresponding applicator element 30. Such pegs may improve the separation of the fibers after the product has been applied.

Because of the tangential contact between two consecutive discs, each narrowed section 34 and 35 separates a first zone or portion delimited by two edge portions which gradually converge towards each other from a second zone or portion delimited by two edge portions which gradually diverge from one another. Thus, two entries for the fibers to be treated are provided for guiding or funneling the fibers towards the same narrowed section.

In the optional embodiment of FIG. 9, the applicator elements (generally carrying the numerical reference 40) include applicator elements of a substantially square shape, of which two corners situated opposite one another have been folded towards one side of the applicator element. The other two corners are arranged substantially in the plane of the applicator element. Thus, the applicator element 41 comprises two corners 42, 43 folded towards two folded corners 44, 45 of an adjacent element 46, arranged in a "face-to-face" configuration with respect to the element 41. The interaction of the folded corners 42, 43 of the applicator element 41 and of the folded corners 44, 45 of the adjacent applicator element 46 makes it possible to delimit two narrowed section 47, 48 between these two applicator elements 41, 46, the two zones 47, 48 lying opposite one another.

Likewise, the applicator element 46 includes two unfolded corners 49 arranged substantially in a plane perpendicular to the axis X of the device. These unfolded corners are brought into contact with two unfolded corners 50 of the applicator element 51 (situated on the opposite side to the element 41 with respect to the element 46) so as to define two narrowed sections 52. The profile of the edges that delimit these narrowed sections 52 are different from the profile of the edges that delimit the narrowed sections 47, 48. Thus, over the periphery of the applicator device according to this embodiment, there are formed four rows of narrowed sections that are offset from one another by 90°.

In the optional embodiment of FIG. 10, the applicator elements (generally carrying the numerical reference 60) include elements of substantially square shape. Two corners lying opposite one another have been folded towards one side of the applicator element, and the other two corners have been folded towards the other side of the applicator element. Thus, the applicator element 61 has two comers 62, 63 folded towards two corners 64, 65 of an adjacent element 66. The two corners 64, 65 of applicator element 66 are themselves folded towards the applicator element 61. The interaction of the folded corners 62, 63 of the applicator element 61 and of the folded corners 64, 65 of the adjacent applicator element 66 makes it possible to delimit two narrowed sections 67, 68 between these two applicator elements 61, 66. The two zones 67 and 68 lie opposite one another with respect to the axis of the device.

Likewise, the applicator element 66 includes two corners 69 folded in the opposite direction to the comers 64, 65. The two corners 69 are brought into contact with two folded corners 70 of the applicator element 71 (located on the opposite side to the element 61 with respect to the element 66) so as to define two narrowed sections 72. The profile of the edges delimiting these narrowed sections 72 is identical to the profile of the edges delimiting the narrowed sections 67, 68. Thus, in the same way as for the previous embodiment, four rows of narrowed sections, offset by 90° from one another, are formed over the periphery of the applicator device.

In the optional embodiment of FIG. 11, the applicator elements (generally carrying the numerical reference 80) include elements of a circular shape oriented perpendicular to the axis X of the applicator device 1. These applicator elements comprise at least one peripheral rim oriented transversely to the plane of the disc, and of width (longitudinally to the axis X and transverse to the plane of the disc) that can vary along the periphery of the disc.

Thus, for instance, applicator element 81 includes a transverse wall 97 forming at its periphery a first rim 82 facing towards one side of the transverse wall 97. The width of the first rim 82 progresses from zero, at a first point 83, to a maximum value at a second point 84 diametrically opposite the point 83 on the disc 81. The rim is oriented parallel to the axis X of the applicator device 1. The point 84 on the disc 81 where the rim 82 is the widest faces the point 88 of maximum width of a rim 85, which is formed on one side of a disc 86 consecutive with the disc 81. Thus, between the two points 84, 88, a narrowed section 87 is defined. In the same way as the rim 82, the rim 85 of the disc 86 is of a width that gradually decreases to become substantially nothing at a point 89. Point 89 is arranged facing the point 83 of minimum width of the rim 82, thus defining a zone of maximum separation between two successive applicator elements.

The maximum width of the rims is of the order of 0.7 mm. In the same way as with the other embodiments, two consecutive elements may be contiguous (or even connected by a bridge material) at the narrowed section they delimit, or may be closely spaced.

Opposite the rim 82, the applicator element 81 has a second rim 90 of a width that varies progressively between a substantially zero value and a maximum value. The variation profile is offset by 180° with respect to the variation profile of the rim 82. As can be seen in FIG. 11, and in the same way as for the rim 82, the zone of maximum width of the rim 90 faces a zone of maximum width of a rim 91, which is formed on a side of a disc 92 (situated on the opposite side to the disc 86 with respect to the disc 81) so as to define a narrowed section 93. Narrowed section 93 is offset by 180° with respect to the narrowed section 87. The zone of narrower width of the rim 90 faces the zone of narrower width of the rim 91 formed by the disc 92.

Thus, according to this optional embodiment, the applicator device has two rows of narrowed sections 87, 93, offset by 180° and each comprising an alternation of narrowed sections 87, 93 and zones of maximum spacing between two successive applicator elements.

The applicator device also comprises front and rear parts 98, 99, profiled so as to make it easier for the applicator device 1 to pass through a wringing-out member or wiper 106, of the type with which the system 100 depicted in FIG. 1 is equipped.

During use, the narrowed sections fulfill the same functions as they did in the previous embodiments. However, the variable-width rims play a part in delimiting, near the narrowed sections, volumes capable of holding a relatively large amount of product. The fibers to be treated will be brought into contact with this volume of product at essentially the same time as they are engaged with the narrowed sections. Thus, the product is both deposited on the fibers and spread out along the fibers. Furthermore, because of the presence of the narrowed sections, the fibers are caught or engaged and therefore curled and/or lengthened.

In the optional embodiment of FIG. 12, the applicator elements may be of a configuration identical, or substantially similar, to that of the applicator elements in the previous embodiment. However, the applicator elements 80 are arranged in pairs so that the zone of maximum width of the rim 85 of a disc 86 faces the zone of minimum width of the rim 82 of the adjacent disc 81. The resulting narrowed section 87 has a different profile from the profile of the narrowed section 87 of the previous embodiment. Likewise, the zone of greater width of the rim 91 of the disc 92 faces the zone of narrower width of the rim 90 of the adjacent disc 81. The resulting narrowed section 93 has a profile identical to that of the narrowed section 87. Furthermore, in each of the two rows of narrowed sections, the latter are more closely spaced than that of the previous optional embodiment, because they are not separated by zones of maximum separation between two applicator elements.

The optional embodiment of FIG. 13 is similar to the optional embodiment of FIG. 11, except that the transverse rims 82, 85, 90, 91 are oriented so that they diverge from the axis X of the device, instead of being oriented so that they are parallel thereto. In the same way as was discussed with reference to FIG. 12, the configuration of the applicator elements 80 could be modified so that the zones of greater width of the rims of a given applicator element are arranged facing the zones of smaller width of the rims of the elements surrounding it, and vice-versa.

The optional embodiment of FIG. 14 is similar to the optional embodiment of FIG. 11, except that the transverse rims 82, 85, 90, 91 are oriented so that they converge with respect to the axis X of the device, instead of being oriented so that they are parallel. In the same way as was discussed with reference to FIG. 12, the configuration of the applicator elements 80 could be modified so that the zones of greater width of the rims of a given applicator element are arranged facing the zones of smaller width of the rims of the elements surrounding it, and vice-versa.

By thus varying the orientation of the peripheral rims, the ability of the applicator elements to transport product and apply product to the fibers to be treated is modified. The separating, lengthening and curling characteristics of the applicator device are also modified. The choice between one configuration or another may be made on the basis of the rheology of the product and/or of the desired characteristics for application. The gentleness of application and the speed thereof are also influenced.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A device for applying a product to keratinous fibers, the device comprising:

a plurality of applicator elements oriented substantially transversely to a longitudinal axis of the device, the plurality of applicator elements comprising a first applicator element and a second applicator element consecutive with the first applicator element;

a first portion of one of a peripheral rim and a peripheral edge of the first applicator element being at a first longitudinal distance from a corresponding first portion of the second applicator element; and a second portion of said one of the peripheral rim and the peripheral edge of the first applicator element being at a second longitudinal distance from a corresponding second portion of the second applicator element;

wherein the second longitudinal distance is less than the first longitudinal distance so as to define at least one narrowed section configured to engage at least one keratinous fiber between the first and second applicator elements.

2. The device of claim 1, wherein the second longitudinal distance is zero, and wherein the second portion of the first applicator element is connected to the corresponding second portion of the second applicator element.

3. The device of claim 1, wherein the corresponding first and second portions of the second applicator element are first and second portions, respectively, of one of a peripheral rim and a peripheral edge of the second applicator element.

4. The device of claim 3, wherein at least two of the applicator elements are connected in a pair via at least one connecting point of one of their respective peripheral rims and peripheral edges, the at least one connecting point acting as a support of the device.

5. The device of claim 1, wherein a third portion of said one of the peripheral rim and the peripheral edge of the first applicator element is at a third longitudinal distance from a corresponding third portion of the second applicator element, wherein the third longitudinal distance is more than the second longitudinal distance so as to define at least one widened section between the first and second applicator elements.

6. The device of claim 1, wherein the applicator elements are connected to a central support.

7. The device of claim 1, wherein the second portion of said one of the peripheral rim and the peripheral edge of the first applicator element contacts at least one point of the corresponding second portion of the second applicator element.

8. The device of claim 1, wherein the smallest distance separating said one of the peripheral rim and the peripheral edge of the first element from the corresponding portion of the second element is non-zero.

9. The device of claim 1, wherein a third longitudinal distance is defined between a third portion of said one of the peripheral rim and the peripheral edge of the first applicator element and a corresponding third portion of the second applicator element, wherein the third longitudinal distance is less than the first longitudinal distance so as to define a second narrowed section between the first and second applicator elements, the second narrowed section being offset angularly about the device from the first narrowed section.

10. The device of claim 9, wherein a plurality of first and second narrowed sections are defined and are arranged in at least two groups, a first group being arranged along a first axis, a second group being arranged along a second axis distinct from the first axis.

11. The device of claim 1, wherein a first portion of one of a peripheral rim and a peripheral edge of a third applicator element is at a third longitudinal distance from a corresponding first portion of a fourth applicator element consecutive with the third applicator element and a second portion of said one of the peripheral rim and the peripheral edge of the third applicator element is at a fourth longitudinal distance from a corresponding second portion of the fourth applicator element, and wherein the fourth longitudinal distance is less than the third longitudinal distance so as to define a second narrowed section between the third and fourth applicator elements, the second narrowed section being offset angularly about the device from the first narrowed section.

12. The device of claim 1, wherein a third longitudinal distance is defined between a third portion of said one of the peripheral rim and the peripheral edge of the first applicator element and a corresponding portion of a third applicator element, and a fourth longitudinal distance is defined between a fourth portion of said one of the peripheral rim and the peripheral edge of the first applicator element and a corresponding portion of the third applicator element, wherein the fourth longitudinal distance is less than the third longitudinal distance so as to define a second narrowed section between the first and third applicator elements, the second narrowed section being offset angularly about the device from the first narrowed section.

13. The device of claim 12, wherein a plurality of first and second narrowed sections are defined and are arranged in at least two groups, a first group being arranged along a first axis, a second group being arranged along a second axis distinct from the first axis.

14. The device of claim 1, wherein at least one of the applicator elements has one of a triangular shape, a circular shape, a square shape, and a hexagonal shape.

15. The device of claim 1, wherein at least one of the applicator elements has at least one of a straight edge portion, a concave edge portion, and a convex edge portion.

16. The device of claim 1, wherein the plurality of applicator elements is formed by one of molding a material, pressing a material, and casting a material.

17. The device of claim 16, wherein said material includes at least one of a filler and a slip agent.

18. The device of claim 16, wherein said material includes at least one of a silicone, a graphite, a Teflon disulfide, a molybdenum disulfide, a bactericide, a magnetized magnetic particle, and a non-magnetized magnetic particle.

19. The device of claim 16, wherein the surface finish of the material is modified so as to improve the ability of the applicator elements to retain product.

20. The device of claim 16, wherein the surface finish of the material is modified by at least one of a chemical, β-radiation, and α-radiation, so as to improve the ability of the applicator elements to retain product.

21. The device of claim 1, wherein the plurality of applicator elements is formed by one of molding a thermoplastic material, pressing a thermoplastic, and casting a thermoplastic material.

22. The device of claim 21, wherein the thermoplastic material is chosen from at least one of a polyethylene, a polypropylene, a polystyrene, a polyethylene terephthalate, a polycarbonate, a polyacetate, an elastomer, a polyurethane, a polyester, a polyvinyl chlorides, a vinyl, a polyamide, and a blend thereof.

23. The device of claim 1, wherein at least one of the applicator elements is covered with flocking.

24. The device of claim 23, wherein the flocking comprises fibers, which fibers comprise at least one of a nylon fiber, a cotton fiber, an acetate fiber, a viscose fiber, a polyester fiber, and a blend thereof.

25. The device of claim 23, wherein the flocking comprises a mixture of fibers of different kinds.

26. The device of claim 23, wherein the flocking comprises a mixture of fibers of different lengths.

27. The device of claim 23, wherein the flocking comprises a mixture of fibers of different diameters.

28. The device of claim 1, wherein the applicator elements are arranged along a substantially straight longitudinal axis.

29. The device of claim 1, wherein the applicator elements are arranged along a curved longitudinal axis.

30. The device of claim 1, wherein at least two consecutive applicator elements are substantially flat and arranged in two planes which are not mutually parallel.

31. The device of claim 30, wherein the two planes are oriented obliquely with respect to the longitudinal axis of the device.

32. The device of claim 30, wherein one of the planes is oriented obliquely with respect to the longitudinal axis of the device and the other of the planes is perpendicular to the longitudinal axis.

33. The device of claim 30, wherein at least one applicator element comprises at least one member projecting from one of the peripheral rim and the peripheral edge of the applicator element.

34. The device of claim 30, wherein the first applicator element defines a first surface and the second applicator element defines a second surface, wherein a narrowed section is defined between the first and the second surfaces, and wherein the first and second applicator elements are not parallel.

35. The device of claim 1, wherein the narrowed section is defined by at least one protrusion of the first applicator element facing at least one corresponding protrusion of the second applicator element, the second applicator element being not parallel to the first applicator element.

36. The device of claim 1, wherein the narrowed section is defined by at least one protrusion of the first applicator element contacting at least one corresponding protrusion of the second applicator element, the second applicator element being not parallel to the first applicator element.

37. The device of claim 1, wherein at least one applicator element is substantially planar and has a shape exhibiting at least three protrusions, at least one of the protrusions extending outside a plane in which a substantial portion of the applicator element is arranged.

38. The device of claim 37, wherein the protrusions extend alternately towards opposite sides of the plane.

39. The device of claim 37, wherein the protrusions extend towards the same side of the plane.

40. The device of claim 37, wherein at least one of the protrusions extends towards one side of the plane and at least one of the other protrusions extends substantially in the plane.

41. The device of claim 40, wherein the protrusions are alternatively arranged so that at least one protrusion extends substantially in the plane and at least another protrusion extends towards the one side of the plane.

42. The device of claim 41, further comprising a third applicator element consecutive with the first and second applicator elements, wherein the first, second and third elements each have a face on one side of the plane and a back on the opposing side, and wherein the first and second applicator elements are arranged face to face and the second and third applicator elements are arranged back to back.

43. The device of claim 37, wherein at least one narrowed section is defined by at least one protrusion of the first applicator element extending towards at least one corresponding protrusion of the second applicator element extending towards the first applicator element.

44. The device of claim 37, wherein at least one narrowed section is defined by at least one protrusion of the first applicator element extending towards at least one corresponding protrusion of the second applicator element extending substantially in the plane.

45. The device of claim 37, wherein at least one narrowed section is defined by at least one protrusion of the first applicator element extending substantially in a plane in which a substantial portion of the first applicator element is arranged and at least one corresponding protrusion of a second applicator element extending substantially in the plane in which a substantial portion of the second applicator element is arranged.

46. The device of claim 37, wherein at least one narrowed section is defined by at least one protrusion of the first applicator element extending substantially in the plane in which a substantial portion of the first applicator element is arranged and at least one corresponding protrusion of a second applicator element extending substantially in the plane in which a substantial portion of the second applicator element is arranged, wherein the protrusions defining the narrowed section contact one another.

47. The device of claim 1, wherein at least one of the applicator elements extends substantially in a plane and has at least one peripheral rim oriented transversely to the plane and surrounding at least part of the applicator element, the width of the rim, in the transverse orientation, being, at least in part, a non-constant width.

48. The device of claim 47, wherein the at least one peripheral rim has at least one portion of gradually increasing transversely oriented width followed by a portion of gradually decreasing transversely oriented width.

49. The device of claim 47, wherein the at least one rim is oriented parallel to the longitudinal axis of the device.

50. The device of claim 47, wherein the at least one rim extends from the plane of at least one applicator element and is oriented so as to diverge from the longitudinal axis of the device.

51. The device of claim 47, wherein the at least one rim extends from the plane and is oriented so as to converge towards the longitudinal axis of the device.

52. The device of claim 47, wherein a first rim faces towards a first side of the plane and a second rim faces towards a second side of the plane, which is the opposite side to the first side.

53. The device of claim 52, wherein the first rim has a profile which is angularly offset about the device with respect to the profile of the second rim.

54. The device of claim 47, wherein the rim is formed in its entirety on one side of the plane.

55. The device of claim 47, wherein the maximum width of the rim ranges from approximately 0.2 mm to approximately 2 mm.

56. The device of claim 47, wherein the maximum width of the rim ranges from approximately 0.4 mm to approximately 1.5 mm.

57. The device of claim 47, wherein the maximum width of the rim ranges from approximately 0.5 mm to approximately 1 mm.

58. The device of claim 47, wherein the at least one narrowed section is defined by at least one portion of greater width of the peripheral rim of the first applicator element arranged facing at least one portion of greater width of the peripheral rim of the second applicator element.

59. The device of claim 47, wherein the at least one narrowed section is defined by at least one portion of greater width of the peripheral rim of the first applicator element arranged in contact with at least one portion of greater width of the peripheral rim of the second applicator element.

60. The device of claim 47, wherein the at least one narrowed section is delimited by at least one portion of greater width of the peripheral rim of the first applicator element arranged facing at least one portion of smaller width of the peripheral rim of the second applicator element.

61. The device of claim 47, wherein the at least one narrowed section is delimited by at least one portion of greater width of the peripheral rim of the first applicator element arranged in contacting with least one portion of smaller width of the peripheral rim of the second applicator element.

62. An applicator comprising:

a device according to claim 1;

an element having a grasping surface; and a stem having a first end coupled to the element and a second end coupled to the device.

63. The applicator of claim 62, wherein the element is configured to reversibly close an opening of a container.

64. The applicator of claim 62, wherein the longitudinal axis of the device is parallel to a longitudinal axis of the stem.

65. The applicator of claim 62, wherein the stem and at least one of the device and the element are formed of a single piece of material.

66. A system for applying a product to keratinous fibers, comprising:

the applicator of claim 62; and a container for containing the product.

67. The system of claim 66, wherein the container defines an opening and the container comprises a wiper located adjacent the opening.

68. The system of claim 67, wherein the wiper is deformable.

69. The system of claim 66, wherein the product is contained in the container and the product is a cosmetic product for one of the eyelashes and the eyebrows.

70. The system of claim 69, wherein the product is mascara.

71. The method of claim 70, wherein the product is mascara.

72. The method of claim 70, wherein the keratinous fiber is one of the eyelashes and eyebrows.

73. The method of claim 72, further comprising removing the applicator from the container and wiping excess product from the device.

74. The device of claim 73, wherein the narrowed section is defined by at least one protrusion of the first applicator element facing at least one corresponding protrusion of the second applicator element, the second applicator element being not parallel to the first applicator element.

75. The device of claim 73, wherein the narrowed section is defined by at least one protrusion of the first applicator element contacting at least one corresponding protrusion of the second applicator element, the second applicator element being not parallel to the first applicator element.

76. The device of claim 73, wherein at least one applicator element is substantially planar and has a shape exhibiting at least three protrusions, at least one of one of the protrusions extending outside a plane in which a substantial portion of the applicator element is arranged.

77. The device of claim 76, wherein the protrusions extend alternately towards opposite sides of the plane.

78. The device of claim 76, wherein the protrusions extend towards the same side of the plane.

79. The device of claim 76, wherein at least one of the protrusions extends towards one side of the plane and at least one of the other protrusions extends substantially in the plane.

80. The device of claim 79, wherein the protrusions are alternatively arranged so that at least one protrusion extends substantially in the plane and at least another protrusion extends towards the one side of the plane.

81. The device of claim 80, further comprising a third applicator element consecutive with the first and second applicator elements, wherein the first, second and third elements each have a face on one side of the plane of the applicator element and a back on the opposing side, and wherein the first and second applicator elements are arranged face to face and the second and third applicator elements are arranged back to back.

82. The device of claim 76, wherein at least one narrowed section is defined by at least one protrusion of the first applicator element extending towards at least one corresponding protrusion of the second applicator element extending towards the first applicator element.

83. The device of claim 76, wherein at least one narrowed section is defined by at least one protrusion of the first applicator element extending towards at least one corresponding protrusion of the second applicator element extending substantially in the plane of the second applicator element.

84. The device of claim 76, wherein at least one narrowed section is defined by at least one protrusion of the first applicator element extending substantially in a plane in which a substantial portion of the first applicator element is arranged and at least one corresponding protrusion of a second applicator element extending substantially in a plane in which a substantial portion of the second applicator element is arranged.

85. The device of claim 76, wherein at least one narrowed section is defined by at least one protrusion of the first applicator element extending substantially in a plane in which a substantial portion of the first applicator element is arranged, and at least one corresponding protrusion of a second applicator element extending substantially in a plane in which a substantial portion of the second applicator element is arranged, wherein the protrusions defining the narrowed section contact one another.

86. The device of claim 73, wherein at least one of the applicator elements extends substantially in a plane and has at least one peripheral rim oriented transversely to the plane and surrounding at least part of the applicator element, the width of the rim, in the transverse orientation, being, at least in part, a non-constant width.

87. The device of claim 86, wherein the at least one peripheral rim has at least one portion of gradually increasing transversely oriented width followed by a portion of gradually decreasing transversely oriented width.

88. The device of claim 86, wherein the at least one rim is oriented parallel to the longitudinal axis of the device.

89. The device of claim 86, wherein the at least one rim extends from the plane of at least one applicator element and is oriented so as to diverge from the longitudinal axis of the device.

90. The device of claim 86, wherein the at least one rim extends from the plane and is oriented so as to converge towards the longitudinal axis of the device.

91. The device of claim 86, wherein a first portion of the rim faces towards a first side of the plane and a second portion of the rim faces towards a second side of the plane, which is the opposite side to the first side.

92. The device of claim 91, wherein the first portion of the rim has a profile which is angularly offset about the device with respect to the profile of the second portion of the rim.

93. The device of claim 86, wherein the rim is formed in its entirety on one side of the plane.

94. The device of claim 86, wherein the maximum width of the rim ranges from approximately 0.2 mm to approximately 2 mm.

95. The device of claim 86, wherein the maximum width of the rim ranges from approximately 0.4 mm to approximately 1.5 mm.

96. The device of claim 86, wherein the maximum width of the rim ranges from approximately 0.5 mm to approximately 1 mm.

97. The device of claim 86, wherein the at least one narrowed section is defined by at least one portion of greater width of the peripheral rim of the first applicator element arranged facing at least one portion of greater width of the peripheral rim of the second applicator element.

98. The device of claim 86, wherein the at least one narrowed section is defined by at least one portion of greater width of the peripheral rim of the first applicator element arranged in contact with at least one portion of greater width of the peripheral rim of the second applicator element.

99. The device of claim 86, wherein the at least one narrowed section is delimited by at least one portion of greater width of the peripheral rim of the first applicator element arranged facing at least one portion of smaller width of the peripheral rim of the second applicator element.

100. The device of claim 86, wherein the at least one narrowed section is delimited by at least one portion of greater width of the peripheral rim of the first applicator element arranged in contact with least one portion of smaller width of the peripheral rim of the second applicator element.

101. The method of claim 70, wherein the loading includes inserting the applicator into the container containing the product.

102. A method for applying a product comprising:

providing the system of claim 66;

loading the product onto the device; and placing the device in contact with a keratinous fiber such that at least some of the product is applied to the fiber.

103. The method of claim 102, further comprising bringing the keratinous fiber into contact with the product contained between the first and second applicator elements.

104. The method of claim 102, further comprising guiding the keratinous fiber into the narrowed section.

105. The method of claim 104, further comprising engaging the keratinous fiber in the narrowed section between the first and second applicator elements.

106. A device for applying a product to keratinous fibers, the device comprising:

a plurality of applicator elements comprising a first substantially planar applicator element oriented at a first angle to a longitudinal axis of the device, and a second substantially planar applicator element oriented at a second angle to the longitudinal axis, the second applicator element being consecutive with the first applicator element;

wherein the first angle and the second angle differ from one another;

wherein a first longitudinal distance is defined between a first portion of one of a peripheral rim and a peripheral edge of the first applicator element and a corresponding first portion of the second applicator element; and wherein a second longitudinal distance is defined between a second portion of one of the peripheral rim and the peripheral edge of the first applicator element and a corresponding second portion of the second applicator element, the second longitudinal distance being less than the first longitudinal distance so as to define at least one narrowed section configured to engage at least one keratinous fiber between the first and second applicator elements.

107. The device of claim 106, wherein the second longitudinal distance is zero, and wherein the second portion of the first applicator element is connected to the corresponding second portion of the second applicator element.

108. The device of claim 106, wherein the corresponding first and second portions of the second applicator element are first and second portions, respectively, of one of a peripheral rim and a peripheral edge of the second applicator element.

109. The device of claim 108, wherein at least two of the applicator elements are connected in a pair via at least one connecting point of one of their respective peripheral rims and respective peripheral edges, the at least one connecting point acting as a support of the device.

110. The device of claim 106, wherein a third portion of said one of the peripheral rim and the peripheral edge of the first applicator element is at a third longitudinal distance from a corresponding third portion of the second applicator element, wherein the third longitudinal distance is more than the second longitudinal distance so as to define at least one widened section between the first and second applicator elements.

111. The device of claim 106, wherein the applicator elements are connected to a central support.

112. The device of claim 106, wherein the second portion of said one of the peripheral rim and the peripheral edge of the first applicator element contacts at least one point of the corresponding second portion of the second applicator element.

113. The device of claim 106, wherein the smallest distance separating said one of the peripheral rim and the peripheral edge of the first element from the corresponding portion of the second element is non-zero.

114. The device of claim 106, wherein a third longitudinal distance is defined between a third portion of said one of the peripheral rim and the peripheral edge of the first applicator element and a corresponding third portion of the second applicator element, and wherein the third longitudinal distance is less than the first longitudinal distance so as to define a second narrowed section between the first and second applicator elements, the second narrowed section being offset angularly about the device from the first narrowed section.

115. The device of claim 114, wherein a plurality of first and second narrowed sections are defined and are arranged in at least two groups, a first group being arranged along a first axis, a second group being arranged along a second axis distinct from the first axis.

116. The device of claim 106, wherein a first portion of one of peripheral rim and a peripheral edge of a third applicator element is at a third longitudinal distance from a corresponding first portion of a fourth applicator element consecutive with the third applicator element and a second portion of said one of the peripheral rim and the peripheral edge of the third applicator element is at a fourth longitudinal distance from a corresponding second portion of the fourth applicator element, and wherein the fourth longitudinal distance is less than the third longitudinal distance so as to define a second narrowed section between the third and fourth applicator elements, the second narrowed section being offset angularly about the device from the first narrowed section.

117. The device of claim 106, wherein a third longitudinal distance is defined between a third portion of said one of the peripheral rim and the peripheral edge of the first applicator element and a corresponding portion of a third applicator element, and a fourth longitudinal distance is defined between a fourth portion of said one of the peripheral rim and the peripheral edge of the first applicator element and a corresponding portion of the third applicator element, wherein the fourth longitudinal distance is less than the third longitudinal distance so as to define a second narrowed section between the first and third applicator elements, the second narrowed section being offset angularly about the device from the first narrowed section.

118. The device of claim 117, wherein a plurality of first and second narrowed sections are defined and are arranged in at least two groups, a first group being arranged along a first axis, a second group being arranged along a second axis distinct from the first axis.

119. The device of claim 106, wherein at least one of the applicator elements has one of a triangular shape, a circular shape, a square shape, and a hexagonal shape.

120. The device of claim 106, wherein at least one of the applicator elements has at least one of a straight edge portion, a concave edge portion, and a convex edge portion.

121. The device of claim 106, wherein the plurality of applicator elements is formed by one of molding a material, pressing a material, and casting a material.

122. The device of claim 121, wherein said material includes at least one of a filler and a slip agent.

123. The device of claim 121, wherein said material includes at least one of a silicone, a graphite, a Teflon disulfide, a molybdenum disulfide, a bactericide, a magnetized magnetic particle, and a non-magnetized magnetic particle.

124. The device of claim 121, wherein the surface finish of the material is modified so as to improve the ability of the applicator elements to retain product.

125. The device of claim 121, wherein the surface finish of the material is modified by at least one of a chemical, $\beta$-radiation, and $\alpha$-radiation, so as to improve the ability of the applicator elements to retain product.

126. The device of claim 106, wherein the plurality of applicator elements is formed by one of molding a thermoplastic material, pressing a thermoplastic, and casting a thermoplastic material.

127. The device of claim 126, wherein the thermoplastic material is chosen from at least one of a polyethylene, a polypropylene, a polystyrene, a polyethylene terephthalate, a polycarbonate, a polyacetate, an elastomer, a polyurethane, a polyester, a polyvinyl chlorides, a vinyl, a polyamide, and a blend thereof.

128. The device of claim 106, wherein at least one of the applicator elements is covered with flocking.

129. The device of claim 128, wherein the flocking comprises fibers, which fibers comprise at least one of a nylon fiber, a cotton fiber, an acetate fiber, a viscose fiber, a polyester fiber, and a blend thereof.

130. The device of claim 128, wherein the flocking comprises a mixture of fibers of different kinds.

131. The device of claim 128, wherein the flocking comprises a mixture of fibers of different lengths.

132. The device of claim 128, wherein the flocking comprises a mixture of fibers of different diameters.

133. The device of claim 106, wherein the applicator elements are arranged along a substantially straight longitudinal axis.

134. The device of claim 106, wherein the applicator elements are arranged along a curved longitudinal axis.

135. The device of claim 106, wherein at least two consecutive applicator elements are substantially flat and arranged in two planes which are not mutually parallel.

136. The device of claim 135, wherein the two planes are oriented obliquely with respect to the longitudinal axis of the device.

137. The device of claim 135, wherein one of the planes is oriented obliquely with respect to the longitudinal axis of the device and the other of the planes is perpendicular to the longitudinal axis.

138. The device of claim 135, wherein at least one applicator element comprises at least one member projecting from one of the peripheral rim and the peripheral edge of the applicator element.

139. The device of claim 135, wherein the first applicator element defines a first surface and the second applicator element defines a second surface, wherein a narrowed section is defined between the first and the second surfaces, and wherein the first and second applicator elements are not parallel.

140. An applicator comprising:

a device according to claim 106;

an element having a grasping surface; and a stem having a first end coupled to the element and a second end coupled to the device.

141. The applicator of claim 140, wherein the element configured to reversibly close an opening of a container.

142. The applicator of claim 140, wherein the longitudinal axis of the device is parallel to a longitudinal axis of the stem.

143. The applicator of claim 140, wherein the stem and at least one of the device and the element are formed of a single piece of material.

144. A system for applying a product to keratinous fibers, comprising:

the applicator of claim 140; and a container for containing the product.

145. The system of claim 144, wherein the container defines an opening and the container comprises a wiper located adjacent the opening.

146. The system of claim 144, wherein the product is contained in the container and the product is a cosmetic product for one of the eyelashes and the eyebrows.

147. The system of claim 146, wherein the product is mascara.

148. A method for applying a product comprising:

providing the system of claim 144;

loading the product onto the device; and placing the device in contact with a keratinous fiber such that at least some of the product is applied to the fiber.

149. The method of claim 148, wherein the product is mascara.

150. The method of claim 149, further comprising bringing the keratinous fiber into contact with the product contained between the first and second applicator elements.

151. The method of claim 149, further comprising guiding the keratinous fiber into the narrowed section.

152. The method of claim 151, further comprising engaging the keratinous fiber in the narrowed section between the first and second applicator elements.

153. The method of claim 148, wherein the keratinous fiber is one of the eyelashes and eyebrows.

154. The method of claim 153, further comprising removing the applicator from the container and wiping excess product from the device.

155. The method of claim 148, wherein the loading includes inserting the applicator into the container containing the product.

156. A device for applying a product to keratinous fibers, the device comprising:

a plurality of substantially planar applicator elements oriented substantially transversely to a longitudinal axis of the device, the applicator elements comprising a first applicator element having a first peripheral rim extending substantially transversely to a plane in which a substantial portion of the first applicator element is arranged, and a second applicator element consecutive with the first applicator element and having a second peripheral rim extending substantially transversely to a plane in which a substantial portion of the second applicator element is arranged;

wherein a first portion of the first peripheral rim and a first portion of the second peripheral rim are spaced apart a first longitudinal distance;

wherein a second portion of the first peripheral rim and a second portion of the second peripheral rim are spaced apart a second longitudinal distance; and wherein the second longitudinal distance is less than the first longitudinal distance to define at least one narrowed section configured to engage at least one keratinous fiber between the first and second applicator elements.

157. The device of claim 156, wherein a third portion of the peripheral rim of the first applicator element is at a third longitudinal distance from a third portion of the second applicator element, and wherein the third longitudinal distance is more than the second longitudinal distance so as to define at least one widened section between the first and second applicator elements.

158. The device of claim 156, wherein the applicator elements are connected to a central support.

159. The device of claim 156, wherein the second portion of the peripheral rim of the first applicator element contacts at least one point of the second portion of the peripheral rim of the second applicator element.

160. The device of claim 156, wherein at least two of the applicator elements are connected in a pair via at least one connecting point of their respective peripheral rims, the at least one connecting point acting as a support of the device.

161. The device of claim 156, wherein the smallest distance separating the peripheral rim of the first applicator element from the peripheral rim of the second element is non-zero.

162. The device of claim 156, wherein a third longitudinal distance is defined between a third portion of the peripheral rim of the first applicator element and a third portion of the peripheral rim of the second applicator element, and wherein the third longitudinal distance is less than the first longitudinal distance so as to define a second narrowed section between the first and second applicator elements, the second narrowed section being offset angularly about the device from the first narrowed section.

163. The device of claim 162, wherein a plurality of first and second narrowed sections are defined and are arranged in at least two groups, a first group being arranged along a first axis, a second group being arranged along a second axis distinct from the first axis.

164. The device of claim 156, wherein a first portion of a peripheral rim of a third applicator element is at a third longitudinal distance from a first portion of a peripheral rim of a fourth applicator element consecutive with the third applicator element and a second portion of the peripheral rim of the third applicator element is at a fourth longitudinal distance from a second portion of the peripheral rim of the fourth applicator element, and wherein the fourth longitudinal distance is less than the third longitudinal distance so as to define a second narrowed section between the third and fourth applicator elements, the second narrowed section being offset angularly about the device from the first narrowed section.

165. The device of claim 156, wherein a third longitudinal distance is defined between a third portion of said one of the peripheral rim and the peripheral edge of the first applicator element and a corresponding portion of a third applicator element, and a fourth longitudinal distance is defined between a fourth portion of said one of the peripheral rim and the peripheral edge of the first applicator element and a corresponding portion of the third applicator element, wherein the fourth longitudinal distance is less than the third longitudinal distance so as to define a second narrowed section between the first and third applicator elements, the second narrowed section being offset angularly about the device from the first narrowed section.

166. The device of claim 165, wherein a plurality of first and second narrowed sections are defined and are arranged in at least two groups, a first group being arranged along a first axis, a second group being arranged along a second axis distinct from the first axis.

167. The device of claim 156, wherein at least one of the applicator elements has one of a triangular shape, a circular shape, a square shape, and a hexagonal shape.

168. The device of claim 156, wherein at least one of the applicator elements has at least one of a straight edge portion, a concave edge portion, and a convex edge portion.

169. The device of claim 156, wherein the plurality of applicator elements is formed by one of molding a material, pressing a material, and casting a material.

170. The device of claim 169, wherein said material includes at least one of a filler and a slip agent.

171. The device of claim 169, wherein said material includes at least one of a silicone, a graphite, a Teflon disulfide, a molybdenum disulfide, a bactericide, a magnetized magnetic particle, and a non-magnetized magnetic particle.

172. The device of claim 169, wherein the surface finish of the material is modified so as to improve the ability of the applicator elements to retain product.

173. The device of claim 169, wherein the surface finish of the material is modified by at least one of a chemical, $\beta$-radiation, and $\alpha$-radiation, so as to improve the ability of the applicator elements to retain product.

174. The device of claim 156, wherein the plurality of applicator elements is formed by one of molding a thermoplastic material, pressing a thermoplastic material, and casting a thermoplastic material.

175. The device of claim 174, wherein the thermoplastic material is chosen from at least one of a polyethylene, a polypropylene, a polystyrene, a polyethylene terephthalate, a polycarbonate, a polyacetate, an elastomer, a polyurethane, a polyester, a polyvinyl chlorides, a vinyl, a polyamide, and a blend thereof.

176. The device of claim 156, wherein at least one of the applicator elements is covered with flocking.

177. The device of claim 176, wherein the flocking comprises fibers, which fibers comprise at least one of a nylon fiber, a cotton fiber, an acetate fiber, a viscose fiber, a polyester fiber, and a blend thereof.

178. The device of claim 176, wherein the flocking comprises a mixture of fibers of different kinds.

179. The device of claim 176, wherein the flocking comprises a mixture of fibers of different lengths.

180. The device of claim 176, wherein the flocking comprises a mixture of fibers of different diameters.

181. The device of claim 156, wherein the applicator elements are arranged along a substantially straight longitudinal axis.

182. The device of claim 156, wherein the applicator elements are arranged along a curved longitudinal axis.

183. The device of claim 156, wherein at least two consecutive applicator elements are substantially flat and arranged in two planes which are not mutually parallel.

184. The device of claim 183, wherein the two planes are oriented obliquely with respect to the longitudinal axis of the device.

185. The device of claim 183, wherein one of the planes is oriented obliquely with respect to the longitudinal axis of the device and the other of the planes is perpendicular to the longitudinal axis.

186. The device of claim 183, wherein at least one applicator element comprises at least one member projecting from the peripheral rim of the applicator element.

187. The device of claim 183, wherein the first applicator element defines a first surface and the second applicator element defines a second surface, wherein a narrowed section is defined between the first and the second surfaces, and wherein the first and second applicator elements are not parallel.

188. The device of claim 156, wherein the narrowed section is defined by at least one protrusion of the first applicator element facing at least one corresponding protrusion of the second applicator element, the second applicator element being not parallel to the first applicator element.

189. The device of claim 156, wherein the narrowed section is defined by at least one protrusion of the first applicator element contacting at least one corresponding protrusion of the second applicator element, the second applicator element being not parallel to the first applicator element.

190. The device of claim 156, wherein at least one applicator element is substantially planar and has a shape exhibiting at least three protrusions, at least one of the protrusions extending outside a plane in which a substantial portion of the applicator element is arranged.

191. The device of claim 190, wherein the protrusions extend alternately towards opposite sides of the plane.

192. The device of claim 190, wherein the protrusions extend towards the same side of the plane.

193. The device of claim 190, wherein at least one of the protrusions extends towards one side of the plane and at least one of the other protrusions extends substantially in the plane of the applicator element.

194. The device of claim 193, wherein the protrusions are alternatively arranged so that at least one protrusion extends substantially in the plane and extends towards the one side of the plane.

195. The device of claim 194 further comprising a third applicator element consecutive with the first and second applicator elements, wherein the first, second and third elements each have a face on one side of the plane of the applicator element and a back on the opposing side, and wherein the first and second applicator elements are arranged face to face and the second and third applicator elements are arranged back to back.

196. The device of claim 190, wherein at least one narrowed section is defined by at least one protrusion of the first applicator element extending towards at least one corresponding protrusion of the second applicator element extending towards the first applicator element.

197. The device of claim 190, wherein at least one narrowed section is defined by at least one protrusion of the first applicator element extending towards at least one corresponding protrusion of the second applicator element extending substantially in the plane.

198. The device of claim 190, wherein at least one narrowed section is defined by at least one protrusion of the first applicator element extending substantially in a plane in which a substantial portion of the first applicator element is arranged and at least one corresponding protrusion of a second applicator element extending substantially in a plane in which a substantial portion of the second applicator element is arranged.

199. The device of claim 190, wherein at least one narrowed section is defined by at least one protrusion of the first applicator element extending substantially in a plane in which a substantial portion of the first applicator element is arranged and at least one corresponding protrusion of a second applicator element extending substantially in a plane in which a substantial portion of the second applicator element is arranged, wherein the protrusions defining the narrowed section contact one another.

200. The device of claim 156, wherein at least one of the applicator elements extends substantially in a plane and has at least one peripheral rim oriented transversely to the plane and surrounding at least part of the applicator element, the width of the rim, in the transverse orientation, being, at least in part, a non-constant width.

201. The device of claim 200, wherein the at least one peripheral rim has at least one portion of gradually increasing transversely oriented width followed by a portion of gradually decreasing transversely oriented width.

202. The device of claim 200, wherein the at least one rim is oriented parallel to the longitudinal axis of the device.

203. The device of claim 200, wherein the at least one rim extends from the plane and is oriented so as to diverge from the longitudinal axis of the device.

204. The device of claim 200, wherein the at least one rim extends from the plane and is oriented so as to converge towards the longitudinal axis of the device.

205. The device of claim 200, wherein a first portion of the rim faces towards a first side of the plane and a second portion of the rim faces towards a second side of the plane, which is the opposite side to the first side.

206. The device of claim 205, wherein the first portion of the rim has a profile which is angularly offset about the device with respect to the profile of the second portion of the rim.

207. The device of claim 200, wherein the rim is formed in its entirety on one side of the plane.

208. The device of claim 200, wherein the maximum width of the rim ranges from approximately 0.2 mm to approximately 2 mm.

209. The device of claim 200, wherein the maximum width of the rim ranges from approximately 0.4 mm to approximately 1.5 mm.

210. The device of claim 200, wherein the maximum width of the rim ranges from approximately 0.5 mm to approximately 1 mm.

211. The device of claim 200, wherein the at least one narrowed section is defined by at least one portion of greater width of the peripheral rim of the first applicator element arranged facing at least one portion of greater width of the peripheral rim of the second applicator element.

212. The device of claim 200, wherein the at least one narrowed section is defined by at least one portion of greater width of the peripheral rim of the first applicator element arranged in contact with at least one portion of greater width of the peripheral rim of the second applicator element.

213. The device of claim 200, wherein the at least one narrowed section is delimited by at least one portion of greater width of the peripheral rim of the first applicator element arranged facing at least one portion of smaller width of the peripheral rim of the second applicator element.

214. The device of claim 200, wherein the at least one narrowed section is delimited by at least one portion of greater width of the peripheral rim of the first applicator element arranged in contact with least one portion of smaller width of the peripheral rim of the second applicator element.

215. An applicator comprising:

a device according to claim 156;

an element having a grasping surface; and a stem having a first end coupled to the element and a second end coupled to the device.

216. The applicator of claim 215, wherein the element is configured to reversibly close an opening of a container.

217. The applicator of claim 215, wherein the longitudinal axis of the device is parallel to a longitudinal axis of the stem.

218. The applicator of claim 215, wherein the stem and at least one of the device and the element are formed of a single piece of material.

219. A system for applying a product to keratinous fibers, comprising:

the applicator of claim 215; and a container for containing the product.

220. The system of claim 219, wherein the container defines an opening and the container comprises a wiper located adjacent the opening.

221. The system of claim 219, wherein the product is contained in the container and the product is a cosmetic product for one of the eyelashes and the eyebrows.

222. The system of claim 221, wherein the product is mascara.

223. A method for applying a product comprising:

providing the system of claim 219;

loading the product onto the device; and placing the device in contact with a keratinous fiber such that at least some of the product is applied to the fiber.

224. The method of claim 223, wherein the product is mascara.

225. The method of claim 224, further comprising bringing the keratinous fiber into contact with the product contained between the first and second applicator elements.

226. The method of claim 224, further comprising guiding the keratinous fiber into the narrowed section.

227. The method of claim 224, further comprising engaging the keratinous fiber in the narrowed section between the first and second applicator elements.

228. The method of claim 223, wherein the keratinous fiber is one of the eyelashes and eyebrows.

229. The method of claim 223, wherein the loading includes inserting the applicator into the container containing the product.

230. The method of claim 223, further comprising removing the applicator from the container and wiping excess product from the device.

231. A device for applying a product to keratinous fibers, the device comprising:

a plurality of substantially discrete applicator elements oriented transversely to a longitudinal axis of the device, the plurality of applicator elements comprising
a first applicator element oriented in a non-perpendicular manner to the longitudinal axis, and
a second applicator element oriented in a non-perpendicular manner to the longitudinal axis, the second applicator element being consecutive with the first applicator element;

a first portion of one of a peripheral rim and a peripheral edge of the first applicator element being at a first longitudinal distance from a corresponding first portion of the second applicator element; and a second portion of said one of the peripheral rim and the peripheral edge of the first applicator element being at a second longitudinal distance from a corresponding second portion of the second applicator element;

wherein the second longitudinal distance is less than the first longitudinal distance so as to define at least one narrowed section between the first and second applicator elements.

232. The device of claim 231, wherein the second longitudinal distance is zero, and wherein the second portion of the first applicator element is connected to the corresponding second portion of the second applicator element.

233. The device of claim 231, wherein the corresponding first and second portions of the second applicator element are first and second portions, respectively, of one of a peripheral rim and a peripheral edge of the second applicator element.

234. The device of claim 231, wherein the applicator elements are connected to a central support.

235. The device of claim 231, wherein at least two of the applicator elements are connected in a pair via at least one connecting point of one of their respective peripheral rims and peripheral edges, the at least one connecting point acting as a support of the device.

236. The device of claim 231, wherein a third longitudinal distance is defined between a third portion of said one of the peripheral rim and the peripheral edge of the first applicator element and a corresponding third portion of the second applicator element, wherein the third longitudinal distance is less than the first longitudinal distance so as to define a second narrowed section between the first and second applicator elements, the second narrowed section being offset angularly about the device from the first narrowed section.

237. The device of claim 231, wherein at least one of the applicator elements has one of a triangular shape, a circular shape, a square shape, and a hexagonal shape.

238. The device of claim 231, wherein at least one of the applicator elements has at least one of a straight edge portion, a concave edge portion, and a convex edge portion.

239. The device of claim 231, wherein the plurality of applicator elements is formed by one of molding a material, pressing a material, and casting a material.

240. The device of claim 239, wherein said material includes at least one of a filler and a slip agent.

241. The device of claim 239, wherein the surface finish of the material is modified so as to improve the ability of the applicator elements to retain product.

242. The device of claim 231, wherein at least one of the applicator elements is covered with flocking.

243. The device of claim 231, wherein the applicator elements are arranged along a substantially straight longitudinal axis.

244. The device of claim 231, wherein the applicator elements are arranged along a curved longitudinal axis.

245. The device of claim 231, wherein at least two consecutive applicator elements are substantially flat and arranged in two planes which are not mutually parallel.

246. The device of claim 245, wherein at least one applicator element comprises at least one member projecting from said one of the peripheral rim and the peripheral edge of the applicator element.

247. The device of claim 231, wherein the first applicator element defines a first surface and the second applicator element defines a second surface, wherein a narrowed section is defined between the first and the second surfaces, and wherein the first and second applicator elements are not parallel.

248. The device of claim 231, wherein the narrowed section is defined by at least one protrusion of the first applicator element facing at least one corresponding protrusion of the second applicator element, the second applicator element being not parallel to the first applicator element.

249. The device of claim 231, wherein the narrowed section is defined by at least one protrusion of the first applicator element contacting at least one corresponding protrusion of the second applicator element, the second applicator element being not parallel to the first applicator element.

250. The device of claim 231, wherein at least one applicator element is substantially planar and has a shape exhibiting at least three protrusions, at least one of the protrusions extending outside a plane in which a substantial portion of the applicator element is arranged.

251. The device of claim 231, wherein at least one of the applicator elements extends substantially in a plane and has at least one peripheral rim oriented transversely to the plane and surrounding at least part of the applicator element, the width of the rim, in the transverse orientation, being, at least in part, a non-constant width.

252. The device of claim 251, wherein the maximum width of the rim ranges from approximately 0.2 mm to approximately 2 mm.

253. The device of claim 231, wherein the narrowed section is configured to engage at least one keratinous fiber between the first and second applicator elements.

254. An applicator comprising:

a device according to claim 231;

an element having a grasping surface; and a stem having a first end coupled to the element and a second end coupled to the device.

255. The applicator of claim 254, wherein the narrowed section of the device is configured to engage at least one keratinous fiber between the first and second applicator elements.

256. The applicator of claim 254, wherein the element is configured to reversibly close an opening of a container.

257. A system for applying a product to keratinous fibers, comprising:

the applicator of claim 254; and a container for containing the product.

258. The system of claim 257, wherein the container defines an opening and the container comprises a wiper located adjacent the opening.

259. The system of claim 257, wherein the narrowed section of the device is configured to engage at least one keratinous fiber between the first and second applicator elements.

260. The system of claim 257, wherein the product is mascara.

261. A method for applying a product comprising:

providing the system of claim 257;

loading the product onto the device; and placing the device in contact with a keratinous fiber such that at least some of the product is applied to the fiber.

262. The method of claim 261, further comprising bringing the keratinous fiber into contact with the product contained between the first and second applicator elements.

263. The method of claim 261, further comprising guiding the keratinous fiber into the narrowed section.

264. The method of claim 261, further comprising engaging the keratinous fiber in the narrowed section between the first and second applicator elements.

265. A device for applying a product to keratinous fibers, the device comprising:

a plurality of substantially discrete applicator elements oriented transversely to a longitudinal axis of the device, the plurality of applicator elements comprising a first applicator element oriented obliquely to the longitudinal axis, and a second applicator element oriented substantially perpendicularly to the longitudinal axis, the second applicator element being consecutive with the first applicator element;

a first portion of one of a peripheral rim and a peripheral edge of the first applicator element being at a first longitudinal distance from a corresponding first portion of the second applicator element; and a second portion of said one of the peripheral rim and the peripheral edge of the first applicator element being at a second longitudinal distance from a corresponding second portion of the second applicator element;

wherein the second longitudinal distance is less than the first longitudinal distance so as to define at least one narrowed section between the first and second applicator elements.

266. The device of claim 265, wherein the second longitudinal distance is zero, and wherein the second portion of the first applicator element is connected to the corresponding second portion of the second applicator element.

267. The device of claim 265, wherein the corresponding first and second portions of the second applicator element are first and second portions, respectively, of one of a peripheral rim and a peripheral edge of the second applicator element.

268. The device of claim 265, wherein the applicator elements are connected to a central support.

269. The device of claim 265, wherein at least two of the applicator elements are connected in a pair via at least one connecting point of one of their respective peripheral rims and peripheral edges, the at least one connecting point acting as a support of the device.

270. The device of claim 265, wherein a third longitudinal distance is defined between a third portion of said one of the peripheral rim and the peripheral edge of the first applicator element and a corresponding third portion of the second applicator element, wherein the third longitudinal distance is less than the first longitudinal distance so as to define a second narrowed section between the first and second applicator elements, the second narrowed section being offset angularly about the device from the first narrowed section.

271. The device of claim 265, wherein at least one of the applicator elements has one of a triangular shape, a circular shape, a square shape, and a hexagonal shape.

272. The device of claim 265, wherein at least one of the applicator elements has at least one of a straight edge portion, a concave edge portion, and a convex edge portion.

273. The device of claim 265, wherein the plurality of applicator elements is formed by one of molding a material, pressing a material, and casting a material.

274. The device of claim 273, wherein said material includes at least one of a filler and a slip agent.

275. The device of claim 273, wherein the surface finish of the material is modified so as to improve the ability of the applicator elements to retain product.

276. The device of claim 265, wherein at least one of the applicator elements is covered with flocking.

277. The device of claim 265, wherein the applicator elements are arranged along a substantially straight longitudinal axis.

278. The device of claim 265, wherein the applicator elements are arranged along a curved longitudinal axis.

279. The device of claim 265, wherein at least two consecutive applicator elements are substantially flat and arranged in two planes which are not mutually parallel.

280. The device of claim 279, wherein at least one applicator element comprises at least one member projecting from said one of the peripheral rim and the peripheral edge of the applicator element.

281. The device of claim 265, wherein the first applicator element defines a first surface and the second applicator element defines a second surface, wherein a narrowed section is defined between the first and the second surfaces, and wherein the first and second applicator elements are not parallel.

282. The device of claim 265, wherein the narrowed section is defined by at least one protrusion of the first applicator element facing at least one corresponding protrusion of the second applicator element, the second applicator element being not parallel to the first applicator element.

283. The device of claim 265, wherein the narrowed section is defined by at least one protrusion of the first applicator element contacting at least one corresponding protrusion of the second applicator element, the second applicator element being not parallel to the first applicator element.

284. The device of claim 265, wherein at least one applicator element is substantially planar and has a shape exhibiting at least three protrusions, at least one of the protrusions extending outside a plane in which a substantial portion of the applicator element is arranged.

285. The device of claim 265, wherein at least one of the applicator elements extends substantially in a plane and has at least one peripheral rim oriented transversely to the plane and surrounding at least part of the applicator element, the width of the rim, in the transverse orientation, being, at least in part, a non-constant width.

286. The device of claim 285, wherein the maximum width of the rim ranges from approximately 0.2 mm to approximately 2 mm.

287. The device of claim 265, wherein the narrowed section is configured to engage at least one keratinous fiber between the first and second applicator elements.

288. An applicator comprising:

a device according to claim 265;

an element having a grasping surface; and a stem having a first end coupled to the element and a second end coupled to the device.

289. The applicator of claim 288, wherein the narrowed section of the device is configured to engage at least one keratinous fiber between the first and second applicator elements.

290. The applicator of claim 288, wherein the element is configured to reversibly close an opening of a container.

291. A system for applying a product to keratinous fibers, comprising:

the applicator of claim 288; and a container for containing the product.

292. The system of claim 291, wherein the container defines an opening and the container comprises a wiper located adjacent the opening.

293. The system of claim 291, wherein the narrowed section of the device is configured to engage at least one keratinous fiber between the first and second applicator elements.

294. The system of claim 291, wherein the product is mascara.

295. A method for applying a product comprising:

providing the system of claim 291;

loading the product onto the device; and placing the device in contact with a keratinous fiber such that at least some of the product is applied to the fiber.

296. The method of claim 295, further comprising bringing the keratinous fiber into contact with the product contained between the first and second applicator elements.

297. The method of claim 295, further comprising guiding the keratinous fiber into the narrowed section.

298. The method of claim 295, further comprising engaging the keratinous fiber in the narrowed section between the first and second applicator elements.

* * * * *

UNITED STATES PATENT AND TRADEMARK OFFICE

CERTIFICATE OF CORRECTION

PATENT NO. : 6,591,842 B2
DATED : July 15, 2003
INVENTOR(S) : Jean-Louis H. Gueret It is certified that error appears in the above-identified patent and that said Letters Patent is hereby corrected as shown below:

Column 17,
Line 62, "a polyvinyl chlorides," should read -- a polyvinyl chloride, --.

Column 20,
Line 14, "with least one portion" should read -- with at least one portion --.
Line 63, "after "at least one of one of the protrusions" should read -- at least one of the protrusions --.

Column 22,
Line 35, "with least one portion" should read -- with at least one portion --.

Column 24,
Line 56, "a polyvinyl chlorides," should read -- a polyvinyl chloride, --.

Column 27,
Line 62, "a polyvinyl chlorides," should read -- a polyvinyl chloride, --.

Column 30,
Line 15, "with least one portion" should read -- with at least one portion --.

Column 33,
Line 35, "element;" should read -- element, --.

Signed and Sealed this

Twenty-eighth Day of September, 2004

JON W. DUDAS
*Director of the United States Patent and Trademark Office*